US007468732B2

(12) United States Patent
Okada

(10) Patent No.: US 7,468,732 B2
(45) **Date of Patent: *Dec. 23, 2008**

(54) CHARACTER DISPLAY APPARATUS AND CHARACTER DISPLAY METHOD, CONTROL PROGRAM FOR CONTROLLING THE CHARACTER DISPLAY METHOD AND RECORDING MEDIUM RECORDING THE CONTROL PROGRAM

(75) Inventor: Satoshi Okada, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/505,406

(22) PCT Filed: Feb. 19, 2003

(86) PCT No.: PCT/JP03/01818

§ 371 (c)(1),
(2), (4) Date: Mar. 28, 2005

(87) PCT Pub. No.: WO03/071516

PCT Pub. Date: Aug. 28, 2003

(65) Prior Publication Data

US 2005/0162426 A1 Jul. 28, 2005

(30) Foreign Application Priority Data

Feb. 25, 2002 (JP) ..... 2002-048258

(51) Int. Cl.
*G09G 5/02* (2006.01)

(52) U.S. Cl. ..... 345/589; 345/613; 345/467; 345/472; 345/690; 345/694

(58) Field of Classification Search ..... 345/467–472.2, 345/581–589, 613–614, 690, 694, 428, 598, 345/619; 382/200–201, 269
See application file for complete search history.

(56) References Cited

U.S. PATENT DOCUMENTS 4,748,443 A * 5/1988 Uehara et al. ..... 345/472.3

(Continued)

FOREIGN PATENT DOCUMENTS

EP 1 026 659 A2 8/2000

(Continued)

OTHER PUBLICATIONS

"How Sub-Pixel Font Rendering Works". [onine] Gibson Research Corporation, Feb. 11, 2002 [retrieved on May 21, 2003] retrieved from the Internet: <URL: http://grc.com/cttech.htm>.

(Continued)

*Primary Examiner*—Kee M Tung
*Assistant Examiner*—Jwalant Amin
(74) *Attorney, Agent, or Firm*—Birch, Stewart, Kolasch & Birch, LLP

(57) ABSTRACT

A character display apparatus is provided, which comprises a display device comprising a plurality of pixels, and a control section for controlling the display device. Each of the plurality of pixels comprises a plurality of sub-pixels arranged in a predetermined direction. A first pixel of the plurality of pixels comprises a plurality of first sub-pixels. At least one pixel neighboring the first pixel comprises a plurality of second sub-pixels. The control section determines an arrangement pattern containing a plurality of elements, in which a value of each of the plurality of elements is determined depending on whether or not a basic portion indicating a skeleton of a character is assigned to a corresponding sub-pixel of the plurality of the first and second sub-pixels. The control section determines a luminance level of the first pixel based on the arrangement pattern.

7 Claims, 16 Drawing Sheets

U.S. PATENT DOCUMENTS

| | | | | |
|---|---|---|---|---|
| 6,188,385 | B1 * | 2/2001 | Hill et al. | 345/614 |
| 6,243,070 | B1 * | 6/2001 | Hill et al. | 345/589 |
| 6,278,434 | B1 | 8/2001 | Hill et al. | |
| 6,282,328 | B1 * | 8/2001 | Desai | 382/308 |
| 6,307,566 | B1 | 10/2001 | Hill et al. | |
| 6,339,426 | B1 * | 1/2002 | Lui et al. | 345/467 |
| 6,342,890 | B1 | 1/2002 | Shetter et al. | |
| 6,342,896 | B1 | 1/2002 | Shetter et al. | |
| 6,421,054 | B1 | 7/2002 | Hill et al. | |
| 6,542,161 | B1 * | 4/2003 | Koyama et al. | 345/589 |
| 7,006,096 | B2 * | 2/2006 | Koyama | 345/469.1 |
| 2002/0008714 | A1 * | 1/2002 | Tezuka et al. | 345/694 |
| 2002/0093502 | A1 * | 7/2002 | Koyama | 345/467 |
| 2003/0011603 | A1 * | 1/2003 | Koyama et al. | 345/470 |

FOREIGN PATENT DOCUMENTS

| | | | |
|---|---|---|---|
| EP | 1 111 579 | A2 | 6/2001 |
| EP | 1 158 485 | A2 | 11/2001 |
| EP | 1 174 854 | A2 | 1/2002 |
| EP | 1 174 855 | A2 | 1/2002 |
| EP | 1 225 560 | A2 | 7/2002 |
| EP | 1 271 466 | A2 | 1/2003 |
| EP | 1 284 471 | A2 | 2/2003 |
| EP | 1 308 924 | A2 | 5/2003 |
| WO | WO-01/09873 | A1 | 2/2001 |
| WO | WO-01/78053 | A2 | 10/2001 |

OTHER PUBLICATIONS

"Sub-Pixel Rendering Implementation Details". [online]. Gibson Research Corporation, Dec. 8, 1999. [retrieved on May 21, 2003]. Retrieved from the Internet: <URL: http://grc.com/cttech.htm>.

"ClearType—What is ClearType?". [online]. Microsoft Corporation, Jan. 6, 2002. [retrieved on May 21, 2003]. Retrieved from the Internet: <URL: http://www.microsoft.com/typography/cleartype/what.htm>.

* cited by examiner

Note: Background color is orange (255, 127, 0); and N=M=3

Correction table 5c

| | | Correction pattern 1 | Correction pattern 2 |
|---|---|---|---|
| Color element level | Sub-pixel 1 | 5 | 4 |
| | Sub-pixel 2 | 2 | 2 |
| | Sub-pixel 3 | 1 | 1 |

*FIG. 11*

Luminance table 5d

| | | Luminance level | | |
|---|---|---|---|---|
| | | R | G | B |
| Color element level | 7 | 0 | 0 | 0 |
| | 6 | 36 | 36 | 36 |
| | 5 | 73 | 73 | 73 |
| | 4 | 109 | 109 | 109 |
| | 3 | 146 | 146 | 146 |
| | 2 | 182 | 182 | 182 |
| | 1 | 219 | 219 | 219 |
| | 0 | 255 | 255 | 255 |

CONVENTIONAL ART

CHARACTER DISPLAY APPARATUS AND CHARACTER DISPLAY METHOD, CONTROL PROGRAM FOR CONTROLLING THE CHARACTER DISPLAY METHOD AND RECORDING MEDIUM RECORDING THE CONTROL PROGRAM

TECHNICAL FIELD

The present invention relates to a character display apparatus and method capable of displaying characters with a high resolution using a color display device. The present invention also relates to a control program for controlling the character display method and a recording medium in which the control program is recorded.

BACKGROUND ART

Some personal computers, word processors, mobile telephones comprise a display section capable of displaying color. As a technique for displaying characters with a high resolution in such apparatuses, for example, Japanese Laid-Open Publication No. 2001-100725 discloses a character display apparatus.

This character display apparatus is provided with a plurality of pixels on a display surface thereof Each pixel comprises a plurality of sub-pixels arranged in a predetermined direction, to which respective colors (e.g., Red (R), Green (G), and Blue (B)) are assigned. The strength of a color element in a sub-pixel is represented by the level of the color element which has a plurality of steps, e.g., 0 to 7. If a certain level of color element is assigned to a sub-pixel corresponding to the skeleton of a character, color element levels which vary stepwise around the sub-pixel are assigned to surrounding sub-pixels. The color element levels are arranged in a predetermined pattern. Each color element level is converted to a luminance level in accordance with predetermined correspondence.

The level of a color element corresponds to the degree of the color element which contributes to the color of a character. The greater the contribution of a sub-pixel to the color of a character, the greater the color element level of the sub-pixel. The greater the contribution of a sub-pixel to the color of a background, the lower the color element level of the sub-pixel. The luminance level of a sub-pixel corresponds to the degree of light emission of the sub-pixel. The greater the luminance level of a sub-pixel, the greater the degree of light emission of the sub-pixel. The lower the luminance level, the lower the degree of light emission. Thus, by controlling the color element level on a sub-pixel-by-sub-pixel basis so as to display the shapes of characters, the characters can be displayed with a higher resolution than when the luminance level is controlled on a pixel-by-pixel basis. Further, by forming a pattern of color element levels which vary stepwise around a sub-pixel corresponding to the skeleton of a character, color noise can be suppressed.

Japanese Laid-Open Publication No. 2001-184051 discloses another character display apparatus capable of displaying characters with a high resolution. In this character display apparatus, a predetermined correspondence between the above-described color element level and luminance level is appropriately changed according to the color of a character to be displayed and the color of a background. As a result, characters can be displayed with a high resolution in any character color and any background color.

FIG. 12 is a block diagram showing a representative configuration of a character display apparatus 1*a* as disclosed in Japanese Laid-Open Publication Nos. 2001-100725 and 2001-184051 described above.

Examples of the character display apparatus 1*a* include any information display apparatuses comprising a display device capable of displaying color, such as electronic apparatuses, information apparatuses, and the like, specifically personal computers and word processors of any type, such as desktop, laptop, and the like. Examples of the character display apparatus 1*a* also include electronic apparatuses comprising a color liquid crystal display device, such as communication apparatuses (e.g., personal digital assistants, mobile telephones including PHS, general fixed telephones, FAX, etc.).

The character display apparatus 1*a* comprises a display device 3. The display device 3 is capable of displaying color. Examples of the display device 3 include liquid crystal displays, organic EL displays, and the like.

The display device 3 is connected to a control section 20. The control section 20 comprises a CPU 2 and a main memory 4. The control section 20 separately controls a plurality of color elements corresponding to a plurality of sub-pixels included in the display device 3. The control section 20 is connected to an input device 7 and an auxiliary memory apparatus 40.

The input device 7 is an apparatus for inputting characters to be displayed on the display device 3, instructions of the user, and the like. Examples of the input device 7 include keyboards, touch panels, mice, and the like.

The auxiliary memory apparatus 40 stores a display program 41*a* for displaying characters, and data 5 including character shape data 5*b*, a correction table 5*c* and a luminance table 5*d*. Examples of the character shape data 5*b* include outline data representing the contour shapes of characters, skeleton data representing the skeletal shapes of characters, bitmap data representing characters, and the like. Note that processing by the display program 41*a* slightly varies depending on the type of the character shape data 5*b*. Characters to be displayed may include simple graphics, such as pictographic characters and the like. In the descriptions below, characters are illustrated.

The correction table 5*c* is used to determine the color element levels of sub-pixels neighboring a sub-pixel corresponding to a basic portion. For example, when the color element level of a sub-pixel corresponding to a basic portion is 7, the color element levels of its neighboring sub-pixels are set to be, for example, 5, 2 and 1 from the nearest to the basic portion. The luminance table 5*d* defines a correspondence between color element levels and luminance levels.

FIGS. 13A and 13B are diagrams for explaining a display surface of the display device 3. The display surface of the display device 3 is provided with a plurality of pixels 10 for displaying characters, graphics, and the like as shown in FIG. 13A. Each pixel 10 comprises 3 sub-pixels 11 arranged in a predetermined direction (a horizontal direction in FIG. 13A), to which respective color elements (e.g., Red (R), Green (G), and Blue (B)) are assigned.

When a character is displayed on the display surface, the basic portion representing the skeleton of the character is assigned to sub-pixels 11 in pixels 10 associated with the character according to the character shape data 5*b*. For example, when a Kanji character "忙" is displayed, the basic portion corresponding to the skeleton of the character is assigned to sub-pixels 11 indicated by hatched portions shown in FIG. 9.

A process for associating the basic portion representing the skeleton of a character with sub-pixels 11 varies depending on the type of the character shape data 5*b*. For example, outline data contains a character code for identifying the type of a character, the number of strokes constituting a single character (the stroke count of a character), the number of contour points constituting a single stroke, the coordinates of contour points constituting a single stroke, and the like. In this case, each stroke has a shape enclosed by a contour line approximated by curved lines, straight lines, arcs, a combination thereof, or the like, and a predetermined thickness so as to display the contour shape of a character. A contour line representing the contour shape of a character can be approximated by straight lines, curved lines, arcs, a combination thereof, or the like, using the coordinate data of contour points. If an area where the inside of a contour line overlaps a sub-pixel is greater than or equal to a predetermined area, such a sub-pixel is determined to correspond to a basic portion representing the skeleton of a character.

Skeleton data contains a character code for identifying the type of a character, the number of strokes constituting a single character, the number of points constituting a single stroke, the line type of a stroke (curved line, straight line, or the like), the coordinates of points constituting a single stroke, and the like. In this case, each stroke is in the form of a line of a certain line type for representing the skeletal shape of a character, and does not have a thickness. If the line type of a stroke is a straight line, the stroke can be approximated by a straight line passing through a plurality of points constituting the stroke using the coordinate data. If the line type of a stroke is a curved line, the stroke can be approximated by a curved line passing through a plurality of points constituting the stroke using the coordinate data. Sub-pixels 11 on a stroke are determined as sub-pixels 12 (FIG. 13) corresponding to the basic portion representing the skeleton of a character.

When a sub-pixel 12 corresponding to the basic portion representing the skeleton of a character is determined, the color element levels of the sub-pixel 12 and a sub-pixel 13 neighboring the sub-pixel 12 are determined. For example, when a sub-pixel 12 (hatched in FIG. 13B), which is located at the middle of three sub-pixels 11 (FIG. 1 3A) constituting a pixel 10, is determined to correspond to a basic portion, the color element level of the sub-pixel 12 corresponding to the basic portion is set to be "7" which is the maximum level. The color element levels of sub-pixels 13 which neighbor the sub-pixel 12 corresponding to the basic portion and are determined not to correspond to the basic portion, are set according to the correction table 5C whose example is shown in FIG. 10. For example, when a correction pattern 1 is selected, the color element levels of the sub-pixels 13 which neighbor the sub-pixel 12 corresponding to the basic portion, are set to be stepwise decreased, e.g., "5", "2", and "1" with an increase in the distance from the sub-pixel 12 corresponding to the basic portion. Alternatively, when a correction pattern 2 is selected, the color element levels of the sub-pixels 13 which neighbor the sub-pixel 12 corresponding to the basic portion, are set to be stepwise decreased, e.g., "4", "2", and "1" with an increase in the distance from the sub-pixel 12 corresponding to the basic portion. The color element level of sub-pixels 14, which are located at a distance of four pixels from the sub-pixel 12 corresponding to the basic portion, is set to be "0" which is intended to represent a background.

Note that when a sub-pixel 13, which does not correspond to a basic portion, neighbors a plurality of sub-pixels 12 corresponding to a basic portion, the color element level of the sub-pixel 13 can take a plurality of values depending on the distance from the sub-pixels 12. In this case, the color element level of the sub-pixel 13 is set to be the greatest value.

The color element level of each sub-pixel is converted to a luminance level according to a correspondence between color element levels and luminance levels defined in the luminance table 5*d* whose example is shown in FIG. 11. In FIG. 13B, the luminance level of the sub-pixel 12 corresponding to the basic portion is set to be "0". The luminance level of a sub-pixel having a color element level of "5", which neighbors the sub-pixel 12, is set to be "73". The luminance level of a sub-pixel having a color element level of "2" is set to be "182". The luminance level of a sub-pixel having a color element level of "1" is set to be "219". The luminance level of the sub-pixel 14, whose color element level is set to "0" as a background, is set to be "255".

FIG. 14 is a flowchart indicating a process flow of the display program 41*a* (FIG. 12) when the character shape data 5*b* is skeleton data.

In step S1, a character code and a character size are input through the input device 7. For example, when a Kanji character "木" is displayed on the display device 3, 4458 (JIS KUTEN code, 44th section and 58th point) is input as a character code. The character size is represented by the number of dots in a horizontal direction and the number of dots in a vertical direction, e.g., 20 dots×20 dots, for example.

In step S2, skeleton data corresponding to the input character code is read from the character shape data 5*b* in the auxiliary memory apparatus 40 and is then stored in the main memory 4 of the control apparatus 20. This skeleton data contains a character code for identifying the type of a character, the number of strokes constituting a single character, the number of points constituting a single stroke, the line type of a stroke, the coordinates of points constituting a single stroke, and the like.

In step S3, the coordinate data of points constituting each stroke is scaled according to the character size input through the input device 7. This scaling converts the coordinate data in the skeleton data defined in a predetermined coordinate system to a real pixel coordinate system for the display device 3. In this case, the scaling is performed by considering the arrangement of sub-pixels. As shown in FIG. 13A, for example, one pixel 10 comprises three sub-pixels 11 arranged in an X direction. When a character size is 20 dots×20 dots, the coordinate data of the skeleton data is scaled into data of 60(=20×3) pixels×20 pixels.

In step S4, the coordinate data of points constituting a stroke is obtained. In step S5, it is determined whether the type of stroke is a straight line or a curved line from the line type of the stroke contained in the skeleton data. When the type of stroke is a straight line, the process goes to step S6. When the type of stroke is a curved line, but not a straight line, the process goes to step S7.

In step S6, the points constituting the stroke are linked with straight lines, and sub-pixels on the straight lines are defined as the basic portion representing the skeleton of a character. In step S7, the coordinate data of the points constituting the stroke is approximated by curved lines, and sub-pixels positioned on the curved lines are defined as the basic portion representing the skeleton of a character.

In step S8, the color element level of the sub-pixel corresponding to the basic portion representing the skeleton of the character, which is defined in step S6 or step S7, is set to be "7" which is the maximum color element level. Next, in step S9, the color element levels of sub-pixels neighboring the sub-pixel corresponding to the basic portion are set according to the correction table 5*c*.

In step S10, it is determined whether or not all strokes contained in a character have been processed. If "Yes", the process goes to step S11. If "No", the process returns to step S3 and is continued. In step S11, the color element levels of the sub-pixels are converted to respective luminance levels according to the luminance table 5*d* indicating the correspondence between color element levels and luminance levels. In step S12, luminance data indicating the luminance levels of the sub-pixels determined in step S11 is transferred to the display device 3.

In this manner, luminance levels are adjusted on a sub-pixel-by-sub-pixel basis to display a character on the display device 3. In this case, sub-pixels corresponding to the basic portion representing the skeleton of a character are obtained from the skeleton data. Alternatively, such sub-pixels may be obtained from outline data, bitmap data, or the like by a predetermined process. Alternatively, the pattern of the basic portion may be previously stored as character shape data in the auxiliary memory apparatus 40 and may be read as required.

In the above-described conventional technique, a pattern of the color element levels of sub-pixels constituting a character is determined, and thereafter, the color element levels are converted to respective luminance levels which are actually displayed on a display section. Therefore, the process is complicated and a working memory area required for the process is increased. As a result, character display processing is slowed, the hardware cost is increased, and the like.

In the above-described conventional technique, when two or more strokes having a predetermined width are near to or cross each other, the space portion within a character is reduced so that the shape of the character is hardly recognized, i.e., "deformed character". To avoid this, a pattern of the color element levels of sub-pixels is changed. However, it is a complicated task to change a pattern of color element levels by actually recognizing the positional relationship between strokes.

When colors can be arbitrarily assigned to characters and backgrounds to be displayed, some combination of the color of a character and the color of a background may not be suitable for a pattern of color element levels, resulting in a degradation in the shape of a character and a significant reduction in the visibility of the character.

DISCLOSURE OF THE INVENTION

According to one aspect of the present invention, a character display apparatus comprises a display device comprising a plurality of pixels, and a control section for controlling the display device. Each of the plurality of pixels comprises a plurality of sub-pixels arranged in a predetermined direction, and at least one of a plurality of color elements is assigned to each of the plurality of sub-pixel. The control section determines at least one sub-pixel, to which a basic portion indicating a skeleton of a character is assigned, among the plurality of sub-pixels in the display device, based on character shape data indicating character shapes. A first pixel of the plurality of pixels comprises a plurality of first sub-pixels. At least one pixel neighboring the first pixel comprises a plurality of second sub-pixels. The control section determines an arrangement pattern containing a plurality of elements, in which a value of each of the plurality of elements is determined depending on whether or not the basic portion is assigned to a corresponding sub-pixel of the plurality of the first sub-pixels and the plurality of the second sub-pixels. The control section determines a luminance level of the first pixel based on the arrangement pattern.

In one embodiment of this present invention, the plurality of elements include a first element and a second element neighboring the first element. A value of the first element indicates that the basic portion is assigned to a sub-pixel relating to the first element. A value of the second element indicates that the basic portion is not assigned to a sub-pixel relating to the second element. The control section determines the luminance level of the first pixel based on another arrangement pattern which is modified from said arrangement pattern such that a value of the first element is interchanged with a value of the second element.

In one embodiment of this invention, the plurality of elements include a first element and a second element neighboring the first element. A value of the first element indicates that the basic portion is assigned to a sub-pixel relating to the first element. A value of the second element indicates that the basic portion is not assigned to a sub-pixel relating to the second element. The control section determines the luminance level of the first pixel based on another arrangement pattern which is modified from said arrangement pattern such that a value of the second element is changed to indicate that the basic pattern is assigned to the sub-pixel relating to the second element.

In one embodiment of this invention, the control section determines the luminance level of the first pixel based on a combination of a color of the character and a background color of the character and the arrangement pattern.

In one embodiment of this invention, the control section compares a combination of a color of the character and a background color of the character with a combination of a predetermined character color and a predetermined background color, and determines the luminance level of the first pixel based on a result of the comparison and the arrangement pattern.

According to another aspect of the present invention, a method for displaying a character on a character display apparatus is provided. The character display apparatus comprises a display device comprising a plurality of pixels and a control section for controlling the display device. Each of the plurality of pixels comprises a plurality of sub-pixels arranged in a predetermined direction, and at least one of a plurality of color elements is assigned to each of the plurality of sub-pixel. A first pixel of the plurality of pixels comprises a plurality of first sub-pixels. At least one pixel neighboring the first pixel comprises a plurality of second sub-pixels. The method comprises the steps of determining at least one sub-pixel, to which a basic portion indicating a skeleton of a character is assigned, among the plurality of sub-pixels in the display device, based on character shape data indicating character shapes, determining an arrangement pattern containing a plurality of elements, in which a value of each of the plurality of elements is determined depending on whether or not the basic portion is assigned to a corresponding sub-pixel of the plurality of the first sub-pixels and the plurality of the second sub-pixels, and determining a luminance level of the first pixel based on the arrangement pattern.

According to another aspect of the present invention, a program for causing a character display apparatus to execute a character display process is provided. The character display apparatus comprises a display device comprising a plurality of pixels and a control section for controlling the display device. Each of the plurality of pixels comprises a plurality of sub-pixels arranged in a predetermined direction, and at least one of a plurality of color elements is assigned to each of the plurality of sub-pixel. A first pixel of the plurality of pixels comprises a plurality of first sub-pixels. At least one pixel neighboring the first pixel comprises a plurality of second sub-pixels. The character display process comprises the steps of determining at least one sub-pixel, to which a basic portion indicating a skeleton of a character is assigned, among the plurality of sub-pixels in the display device, based on character shape data indicating character shapes, determining an arrangement pattern containing a plurality of elements, in which a value of each of the plurality of elements is determined depending on whether or not the basic portion is assigned to a corresponding sub-pixel of the plurality of the first sub-pixels and the plurality of the second sub-pixels, and determining a luminance level of the first pixel based on the arrangement pattern.

According to another aspect of the present invention, a recording medium storing a program for causing a character display apparatus to execute a character display process is provided. The recording medium is readable by the character display apparatus. The character display apparatus comprises a display device comprising a plurality of pixels and a control section for controlling the display device. Each of the plurality of pixels comprises a plurality of sub-pixels arranged in a predetermined direction, and at least one of a plurality of color elements is assigned to each of the plurality of sub-pixel. A first pixel of the plurality of pixels comprises a plurality of first sub-pixels. At least one pixel neighboring the first pixel comprises a plurality of second sub-pixels. The character display process comprises the steps of determining at least one sub-pixel, to which a basic portion indicating a skeleton of a character is assigned, among the plurality of sub-pixels in the display device, based on character shape data indicating character shapes, determining an arrangement pattern containing a plurality of elements, in which a value of each of the plurality of elements is determined depending on whether or not the basic portion is assigned to a corresponding sub-pixel of the plurality of the first sub-pixels and the plurality of the second sub-pixels, and determining a luminance level of the first pixel based on the arrangement pattern.

Functions of the present invention will be described below.

According to the present invention, the display surface of the display section is provided with a plurality of pixels each containing a plurality of sub-pixels arranged in a predetermined direction. At least one of a plurality of color elements is assigned to each sub-pixel. When displaying a character on the display surface of the display section, sub-pixels corresponding to the basic portion representing the skeleton of a character are determined from the sub-pixels based on character shape data representing the shapes of characters, such as skeleton data representing the skeletal shapes of characters, outline data representing the contour shapes of characters, bitmap data representing characters, or the like. The arrangement pattern of sub-pixels in a pixel whose luminance level is to be determined and its neighboring sub-pixels are determined. Based on the arrangement pattern of sub-pixels, the luminance levels of sub-pixels contained in the pixel are determined. The luminance levels of all pixels in the display surface are determined in this manner so that the character is displayed on the display section.

Therefore, when displaying characters with high resolution and high definition, luminance levels can be determined only by extracting arrangements of sub-pixels corresponding to a basic portion (as used herein, the term "arrangement of sub-pixels corresponding to a basic portion" indicates an arrangement of sub-pixels each corresponding to a basic portion or a non-basic portion of a character). Therefore, processes can be simplified and the processes can be performed at practical speed even using a CPU having a low processing speed, as compared to a conventional technique in which the color element level of a sub-pixel corresponding to a basic portion and the color element levels of sub-pixels neighboring that sub-pixel are determined before the color element levels are used to determine the color luminance level of a pixel of interest. Further, the size of a control program describing a procedure can be reduced, thereby making it possible to reduce the size of an auxiliary memory apparatus. Furthermore, the simplification of processes can reduce a working memory region required during processing. As a result, the cost of a character display apparatus can be reduced, thereby making it possible to realize a character display with high resolution and high definition.

According to the present invention, when the luminance levels of sub-pixels contained in a pixel of interest are determined based on the arrangement of sub-pixels corresponding to a basic portion, the position of a sub-pixel corresponding to a basic portion is replaced with its neighboring sub-pixel, and the arrangement of sub-pixels including such a replacement is used to determine the luminance levels of sub-pixels contained in a pixel of interest. Therefore, when sub-pixels corresponding to the skeleton of a character are close to each other, the arrangement of sub-pixels can be changed so that such sub-pixels are spaced to a further distance. Thereby, it is possible to prevent space within a character from being diminished to deform the character when strokes of the character are close to each other. The arrangement of sub-pixels corresponding to the skeleton of a character may not be suitable for the shape of the character, depending on a color combination of a character and a background. Even in this situation, by changing the arrangement of sub-pixels corresponding to the skeleton, distortion of the character can be corrected.

According to the present invention, when the luminance levels of sub-pixels contained in a pixel of interest is determined based on the arrangement of sub-pixels corresponding to a basic portion, a sub-pixel corresponding to a basic portion is duplicated and provided to its neighboring sub-pixel. The arrangement of sub-pixels including the duplicate sub-pixels can be used to determine the luminance levels of sub-pixels contained in a pixel of interest. Thus, a sub-pixel corresponding to the skeleton of a character can be multiplexed, thereby making it possible to simplify a process of thickening the line width of a character so that the process can be efficiently performed.

According to the present invention, when the luminance levels of sub-pixels contained in a pixel of interest are determined based on the arrangement of sub-pixels corresponding to a basic portion, the correspondence between the arrangement of sub-pixels and the luminance levels of sub-pixels contained in a pixel of interest can be changed depending on a combination of a character color and a background color. Therefore, the optimum luminance levels of sub-pixels contained in a pixel of interest can be determined depending on a character color and a background color. Therefore, characters having an optimum line width can be displayed for each color combination, whereby characters can be displayed with a high level of visibility irrespective of a color combination.

According to the present invention, when the luminance levels of sub-pixels contained in a pixel of interest are determined based on the arrangement of sub-pixels corresponding to a basic portion, the correspondence between the arrangement of sub-pixels and the luminance levels of sub-pixels contained in a pixel of interest can be changed according to the size of the difference between character and background colors previously registered and character and background colors to be displayed. The above-described correspondence can be shared by a group of characters having similar color combinations (similar luminance levels of sub-pixels), whereby characters can be displayed with a more variety of color combinations and an optimum line width while suppressing the storage capacity of a character display apparatus to a small level.

Thus, the invention described herein makes possible the advantages of (1) providing a character display apparatus and method capable of displaying characters with a high resolution and definition by a simple process, wherein the speed of character display processing is increased and the hardware cost can be decreased; (2) a control program for controlling the character display method; and a recording medium in which the control program is stored.

These and other advantages of the present invention will become apparent to those skilled in the art upon reading and understanding the following detailed description with reference to the accompanying figures.

BRIEF DESCRIPTION OF THE DRAWINGS

FIG. 11 is a diagram showing an exemplary luminance table in a character display apparatus.

BEST MODE FOR CARRYING OUT THE INVENTION

Hereinafter, the present invention will be described by way of illustrative examples with reference to the accompanying drawings.

Figure 1:
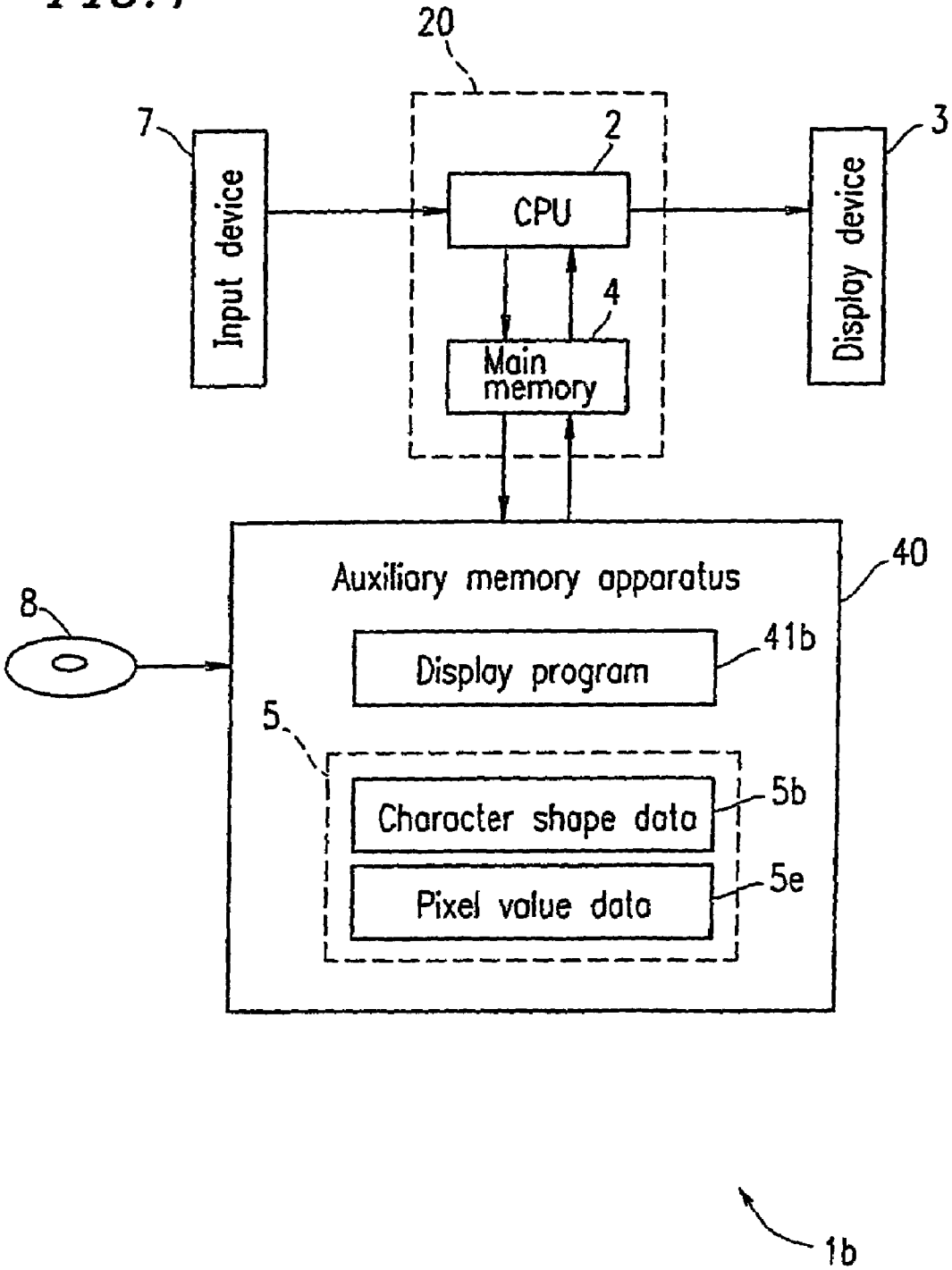
FIG. 1 is a block diagram showing a configuration of a character display apparatus according to an embodiment of the present invention.

FIG. 1 is a block diagram showing a configuration of a character display apparatus according to an embodiment of the present invention. Examples of the character display apparatus 1*b* include any information display apparatuses comprising a display device capable of displaying color, such as electronic apparatuses, information apparatuses, and the like, specifically personal computers and word processors of any type, such as desktop, laptop, and the like. Examples of the character display apparatus 1*b* also include electronic apparatuses comprising a color liquid crystal display device, such as communication apparatuses (e.g., personal digital assistants, mobile telephones including PHS, general fixed telephones, FAX, etc.).

The character display apparatus 1*b* comprises a display device 3 comprising a plurality of pixels. The display device 3 is capable of displaying color. Examples of the display device 3 include liquid crystal displays, organic EL displays, and the like.

The display device 3 is connected to a control section 20. The control section 20 controls the operation of the display device 3. The control section 20 comprises a CPU 2 and a main memory 4. The control section 20 separately controls a plurality of color elements corresponding to a plurality of sub-pixels included in the display device 3. The control section 20 is connected to an input device 7 and an auxiliary memory apparatus 40.

The input device 7 is an apparatus for inputting characters to be displayed on the display device 3, instructions of the user, and the like. Examples of the input device 7 include keyboards, touch panels, mice, and the like.

The auxiliary memory apparatus 40 stores a display program 41*b* for displaying characters and data 5 containing character shape data 5*b* and a pixel value table 5*e*. A recording medium 8 (e.g., an optical disc), which is readable by the character display apparatus 1*b*, stores the display program 41*b* and the data 5. The display program 41*b* and the data 5 may be installed from the recording medium 8 to the auxiliary memory apparatus 40 or may be previously stored in the auxiliary memory apparatus 40. Examples of the character shape data 5*b* include outline data representing the contour shapes of characters, skeleton data representing the skeletal shapes of characters, bitmap data representing characters, and the like. Note that processing by the display program 41*b* slightly varies depending on the type of the character shape data 5*b*. Characters to be displayed may include simple graphics, such as pictographic characters and the like. In descriptions below, characters are illustrated.

The pixel value table 5*e* contains a correspondence between the arrangement pattern of a basic portion comprising M+2×N sub-pixels (M sub-pixels contained in a pixel (pixel of interest) whose luminance level is determined and N sub-pixels neighboring each side of the M sub-pixels), and the luminance levels (pixel value) of the M sub-pixels of the pixel of interest.

Figure 2A:
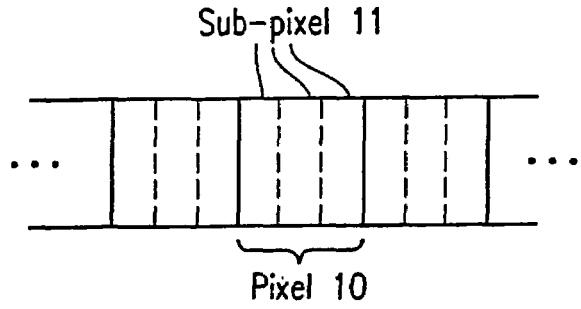
FIGS. 2A to 2C are diagrams for explaining an arrangement of sub-pixels and a correction pattern in a character display apparatus according to an embodiment of the present invention.
Figure 2B:
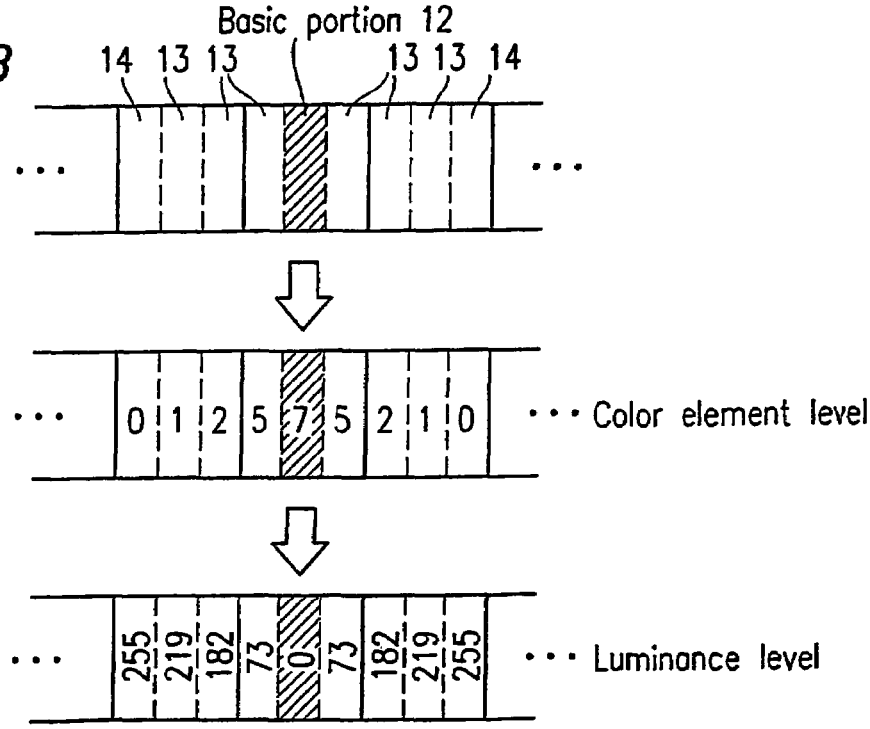
Figure 2C:
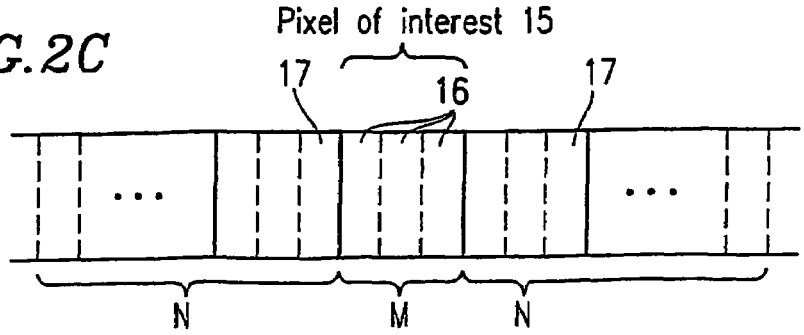

FIGS. 2A to 2C are diagrams for explaining a display surface of the display device 3. The display surface of the display device 3 is provided with a plurality of pixels 10 for displaying characters, graphics, and the like as shown in FIG. 2A. Each pixel 10 comprises 3 sub-pixels 11 arranged in a predetermined direction (a horizontal direction in FIG. 2A), to each of which at least one color element (e.g., Red (R), Green (G), and Blue (B)) is assigned.

When a character is displayed on the display surface, the basic portion representing the skeleton of the character is assigned to sub-pixels 11 in pixels 10 associated with the character according to the character shape data 5*b*. For example, when a Kanji character "亡" is displayed, the basic portion corresponding to the skeleton of the character is assigned to sub-pixels 11 indicated by hatched portions shown in FIG. 9.

A process for associating the basic portion representing the skeleton of a character with sub-pixels 11 varies depending on the type of the character shape data 5*b*. For example, outline data contains a character code for identifying the type of a character, the number of strokes constituting a single character (the stroke count of a character), the number of contour points constituting a single stroke, the coordinates of contour points constituting a single stroke, and the like. In this case, each stroke has a shape enclosed by a contour line approximated by curved lines, straight lines, arcs, a combination thereof, or the like, and a predetermined thickness so as to display the contour shape of a character. A contour line representing the contour shape of a character can be approximated by straight lines, curved lines, arcs, a combination thereof, or the like, using the coordinate data of contour points. If an area where the inside of a contour line overlaps a sub-pixel is greater than or equal to a predetermined area, such a sub-pixel is determined to correspond to a basic portion representing the skeleton of a character.

Skeleton data contains a character code for identifying the type of a character, the number of strokes constituting a single character, the number of points constituting a single stroke, the line type of a stroke (curved line, straight line, or the like), the coordinates of points constituting a single stroke, and the like. In this case, each stroke is in the form of a line of a certain line type for representing the skeletal shape of a character, and does not have a thickness. If the line type of a stroke is a straight line, the stroke can be approximated by a straight line passing through a plurality of points constituting the stroke using the coordinate data. If the line type of a stroke is a curved line, the stroke can be approximated by a curved line passing through a plurality of points constituting the stroke using the coordinate data. Sub-pixels 11 on a stroke are determined as sub-pixels 12 (FIG. 2B) corresponding to the basic portion representing the skeleton of a character.

The bitmap data has binary values. Each bit constituting the bitmap data has a value of "1" or "0". A bit having a value of "1" represents a black portion in graphics. A bit having a value of "0" represents a white portion in a graphic. A basic portion of a graphic corresponds to a core in a graphic. When a graphic is a character, the basic portion is a middle portion of a stroke. In the bitmap data, stroke information is lost. Bits in the bitmap data are associated with the basic portion by inference. The basic portion cannot be inferred only by information of bit D(x, y) of interest. However, the basic portion is inferred based on information of bits neighboring bit D of interest. It is initially determined whether or not each bit constituting the bitmap data is "1", so as to investigate the "1"/"0" arrangement pattern of neighboring bits around the bit of interest. The bit of interest is associated with a pixel. Among the subpixels of the pixel with which the bit of interest is associated, a sub-pixel 12 corresponding to the basic portion is determined according to the arrangement pattern of the neighboring bits.

Figure 15:
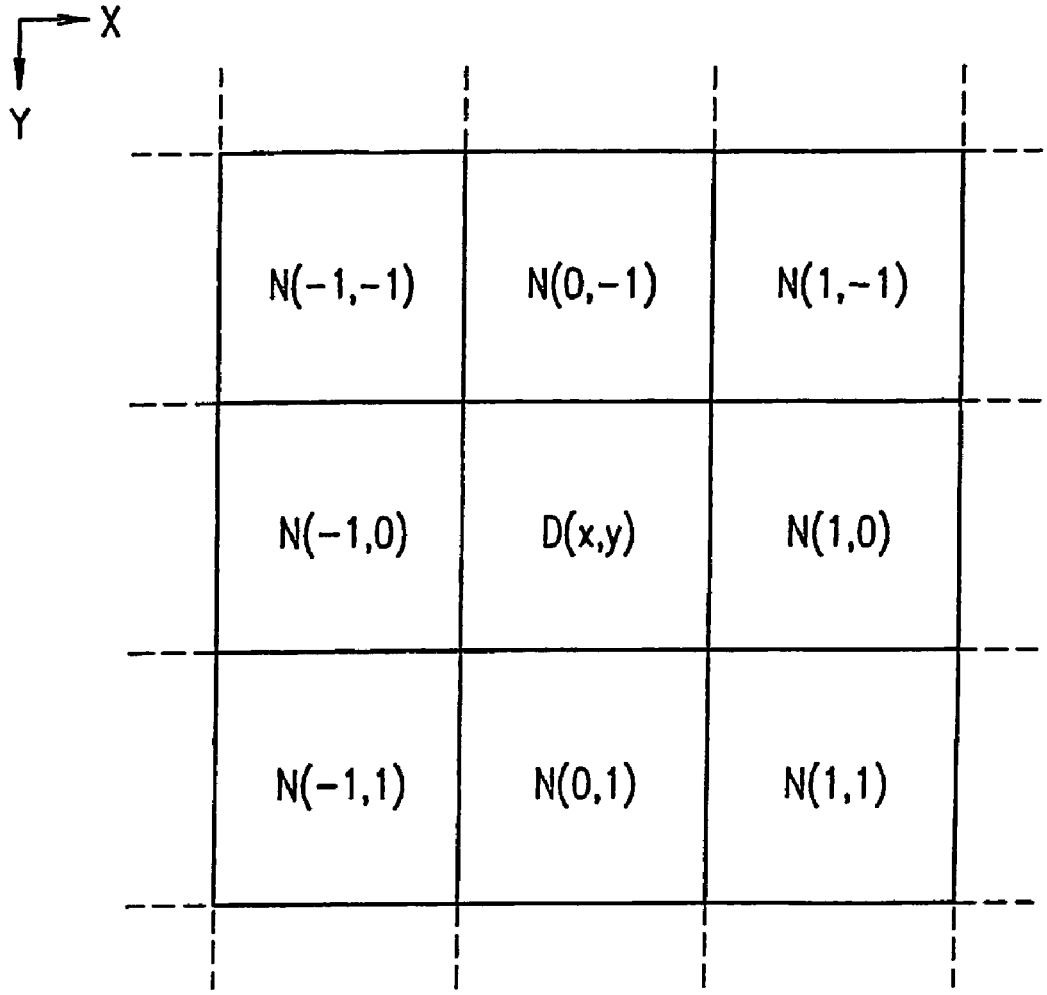
FIG. 15 is a diagram showing a portion of bitmap data representing graphics.

FIG. 15 is a diagram showing a portion of bitmap data representing a graphic. D(x, y) represents a bit of interest. N(a, b) represents bit D(x+a, y+b) around D(x, y). FIG. 15 shows eight bits N(−1, 1), N(0, −1), N(1, −1), N(−1, 0), N(1, 0), N(−1, 1), N(0, 1), and N(1, 1) neighboring bit D(x, y) in a vertical, horizontal, or slant direction. These eight neighboring bits are called eight neighbors. N(a, b) and D(x, y) each has a value of "1" or "0".

Figure 16:
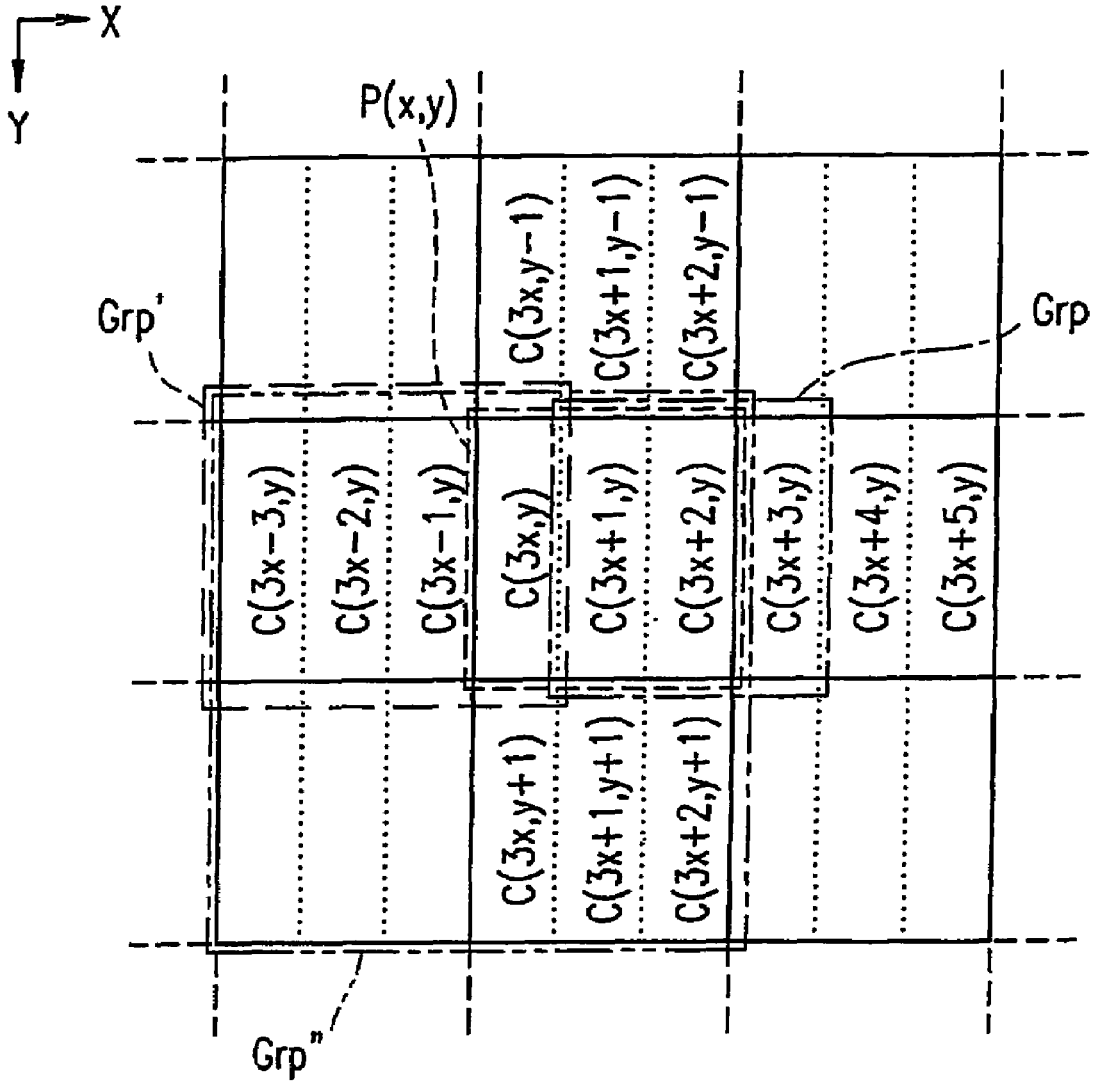
FIG. 16 is a diagram showing a portion of a display surface of a display device.

FIG. 16 is a diagram showing a portion of the display surface of a display device. P(x, y) represents a pixel on the display surface. Bit D(x, y) shown in FIG. 15 is associated with pixel P(x, y) when a graphic represented by bitmap data is displayed on a display device. P(x, y) contains three sub-pixels C(3x, y), C(3x+1, y) and C(3x+2, y). When D (x, y) has a value of "1", a sub-pixel corresponding to a basic portion is determined among the three sub-pixels C(3x, y), C(3x+1, y) and C(3x+2, y) according to a definition rule. When D(x, y) has a value of "0", none of the three sub-pixels is determined as a sub-pixel corresponding to the basic portion. Note that although bit D(x, y) shown in FIG. 15 is associated with a sub-pixel group Grp shown in FIG. 16, the number of sub-pixels contained in a group is not necessarily equal to the number of sub-pixels contained in a pixel. For example, a bit in the bitmap data may be associated with a group Grp' consisting of four sub-pixels shown in FIG. 16. The direction of arrangement of sub-pixels in a group is not limited to an X direction. For example, a bit in the bitmap data may be associated with a group Grp" in which sub-pixels are arranged in the X direction and the Y direction as shown in FIG. 16.

Figure 17A:
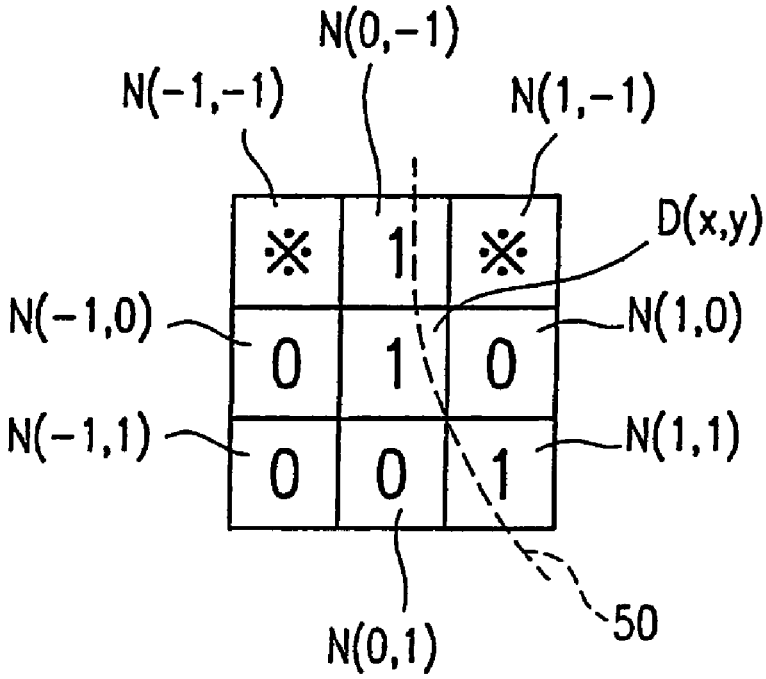
FIG. 17A is a diagram showing a bit of interest and 8 neighbors in bitmap data.
Figure 17B:
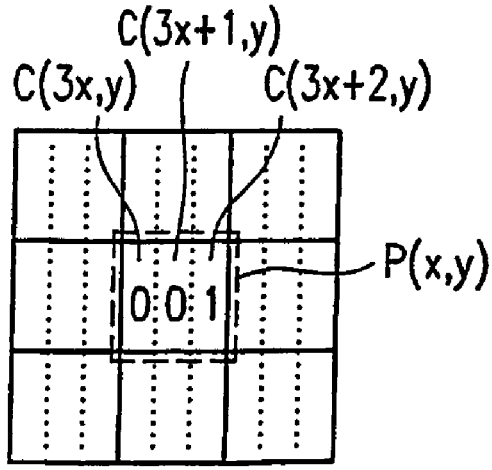
FIG. 17B is a diagram showing a sub-pixel associated with a basic portion according to a basic portion definition rule in the bit of interest and its 8 neighbors of FIG. 17A.

FIG. 17A shows an example of 8 neighbors of a bit of interest D(x, y) in the bitmap data. Bit N(a, b) having a value of "1" is represented by N(a, b). In FIG. 17A, N(0, −1)=N(1, 1)=1, N(1, 0)=N(0, 1)=N(−1, 1)=N(−1, 0)=0, and N(−1, −1) and N(1, −1) represented by "X" has any one of "0" and "1". FIG. 17B is a diagram showing a sub-pixel which is associated with a basic portion according to a basic portion definition rule when 8 neighboring bits of bit D(x, y) have values shown in FIG. 17A. According to the basic portion definition rule, whether or not each of three sub-pixels contained in pixel P(x, y) is associated with a basic portion is determined based on the arrangement of "0" and "1" of bits N(a, b) around bit D(x, y) associated with pixel P(x, y) as follows. Note that bit D(x, y) is assumed to have a value of "1" below. As shown in FIG. 16, pixel P(x, y) on the display surface corresponding to bit D(x, y) contains three sub-pixels C(3x, y), C(3x+1, y) and C(3x+2, y). Among these sub-pixels, a sub-pixel having a value of "1" in FIG. 17B is associated with a basic portion, while sub-pixels having a value of "0" are not associated with a basic portion. Specifically, sub-pixel C(3x+2, y) is associated with a basic portion, while C(3x, y) and C(3x+1, y) are not associated with a basic portion. For example, in the bitmap data of FIG. 17A, a stroke is inferred to be a curved line (dashed line 50 in FIG. 17A) which passes through areas corresponding to bits N(0, −1), D(x, y), and N(1, 1). Such a curved line is considered to pass through the right-hand side of an area corresponding to bit D(x, y). Therefore, in FIG. 17B, sub-pixel C(3x+2, y) on the right-hand side of pixel P(x, y) corresponding to bit D(x, y) is associated with a basic portion.

When a sub-pixel 12 corresponding to the basic portion representing the skeleton of a character is determined, the color element levels of the sub-pixel 12 and a sub-pixel 13 neighboring the sub-pixel 12 are determined. For example, when a sub-pixel 12 (hatched in FIG. 2B), which is located at the middle of three sub-pixels 11 (FIG. 2A) constituting a pixel 10, is determined to correspond to a basic portion, the color element level of the sub-pixel 12 corresponding to the basic portion is set to be "7" which is the maximum level. The color element levels of sub-pixels 13 which neighbor the sub-pixel 12 corresponding to the basic portion and are determined not to correspond to the basic portion, are set to be stepwise decreased, e.g., "5", "2", and "1" with an increase in the distance from the sub-pixel 12 corresponding to the basic portion. The color element level of sub-pixels 14, which are located at a distance of four pixels from the sub-pixel 12 corresponding to the basic portion, is set to be "0" which is intended to represent a background.

Note that when a sub-pixel 13, which does not correspond to a basic portion, neighbors a plurality of sub-pixels 12 corresponding to a basic portion, the color element level of the sub-pixel 13 can take a plurality of values depending on the distance from the sub-pixels 12. In this case, the color element level of the sub-pixel 13 is set to be the greatest value.

The color element level of each sub-pixel is converted to a luminance level according to a correspondence between color element levels and luminance levels. In FIG. 2B, the luminance level of the sub-pixel 12 corresponding to the basic portion is set to be "0". The luminance level of a sub-pixel having a color element level of "5", which neighbors the sub-pixel 12, is set to be "73". The luminance level of a sub-pixel having a color element level of "2" is set to be "182". The luminance level of a sub-pixel having a color element level of "1" is set to be "219". The luminance level of the sub-pixel 14, whose color element level is set to "0" as a background, is set to be "255".

In this embodiment, a luminance level is determined as follows. As shown in FIG. 2C, a sub-pixel(s) corresponding to a basic portion (i.e., a sub-pixel(s) to which a basic portion is assigned) is extracted from M+2×N sub-pixels (M sub-pixels 16 contained in a pixel (pixel of interest) 15 whose luminance level is to be determined and N sub-pixels 17 neighboring on each side of pixel 15). Based on the arrangement pattern of the extracted sub-pixel(s), the luminance levels (i.e., pixel value) of M sub-pixels 16 contained in the pixel 15 of interest are determined.

Figure 3:
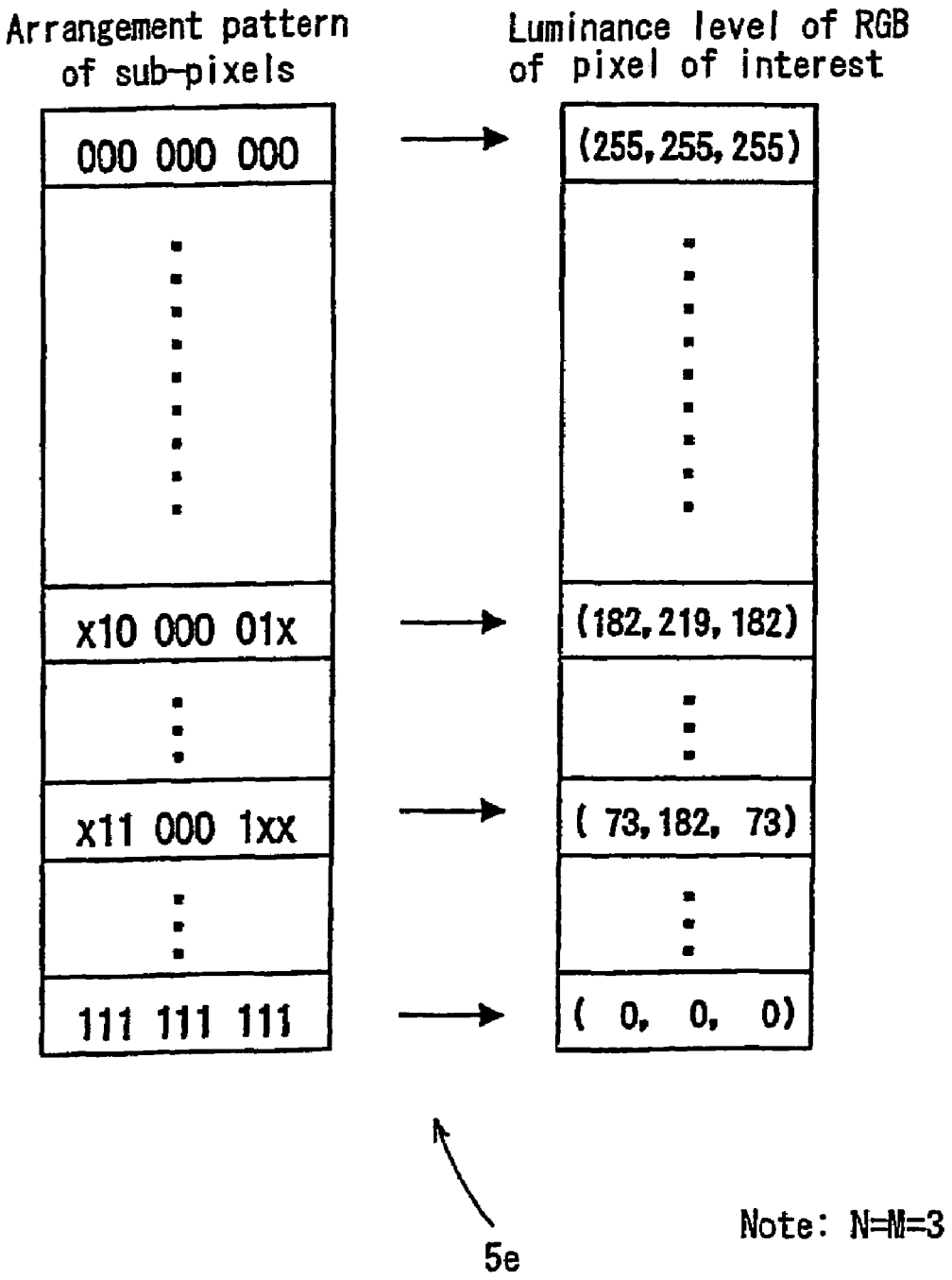
FIG. 3 is a diagram showing an example of a pixel value table in a character display apparatus according to an embodiment of the present invention.

FIG. 3 is a diagram showing an example of the pixel value table 5*e*. In FIG. 3 and FIGS. 4 to 7, it is assumed that the number (M) of the sub-pixels 16 contained in the pixel 15 of interest shown in FIG. 2C is 3 (M=3), and the number (N) of the sub-pixels 17 on each side of the pixel 15 is 3 (N=3). Note that the number N of the above-described pixels is typically the same as the number of elements in a correction pattern (N=3 in FIG. 10). The left-hand side of FIG. 3 shows an arrangement pattern of 9 sub-pixels contained in 3 pixels (the pixel 15 of interest and pixels on the both sides thereof) which are arranged in the same direction as that of the arrangement of the sub-pixels. An arrangement pattern contains a plurality of elements. The value of each element is determined by the control section 20 depending on whether or not a basic portion is assigned to a corresponding sub-pixel of the subpixels 16 and the subpixels 17. In the figures, element "0" indicates that a basic portion is not assigned to a sub-pixel relating to the element; element "1" indicates that a basic portion is assigned to a sub-pixel relating to the element; and element "x" indicates that either a basic portion is assigned to a sub-pixel relating to the element or a basic portion is not assigned to a sub-pixel relating to the element. The right-hand side of FIG. 3 shows the luminance value of each sub-pixel (R, G, B) contained in a pixel of interest corresponding to the arrangement pattern on the left side of FIG. 3.

The pixel value of a pixel is determined using the pixel value table 5*e* indicating a correspondence between the arrangement pattern of sub-pixels corresponding to the basic portion of a character and the luminance values of sub-pixels contained in a pixel whose pixel value (the luminance levels of sub-pixels) is to be determined. The above-described correspondence indicated by the pixel value table 5*e* is predetermined.

For example, it is assumed that the arrangement pattern of sub-pixels corresponding to a basic portion is "x10 000 O1x". For example, when the correspondence indicated by the pixel value table 5*e* has been determined using the correction pattern 1 shown in FIG. 10, the arrangement of the color element levels is "x75, 212, 57x". The color element levels (2, 1, 2) of sub-pixels (R, G, B) contained in a pixel of interest whose pixel value is to be determined are converted to luminance levels (182, 219, 182) when the correspondence indicated by the pixel value table 5*e* has been determined using the correspondence between color element levels and luminance levels shown in FIG. 11. Therefore, in the pixel value table 5*e* of FIG. 3, the arrangement pattern "x1O 000 01x" of the sub-pixels corresponding to a basic portion previously corresponds to the pixel values (182, 219, 182) of the pixel. The other arrangement patterns previously correspond to the pixel values of pixels.

Note that when a pixel of interest is located at an end of a display device, no neighboring pixel is present at one side of the pixel of interest. In this case, another process is performed. For example, when a pixel of interest is located at an end of a display device, the luminance level of the pixel of interest may be inevitably set to (255, 255, 255).

Figure 4:
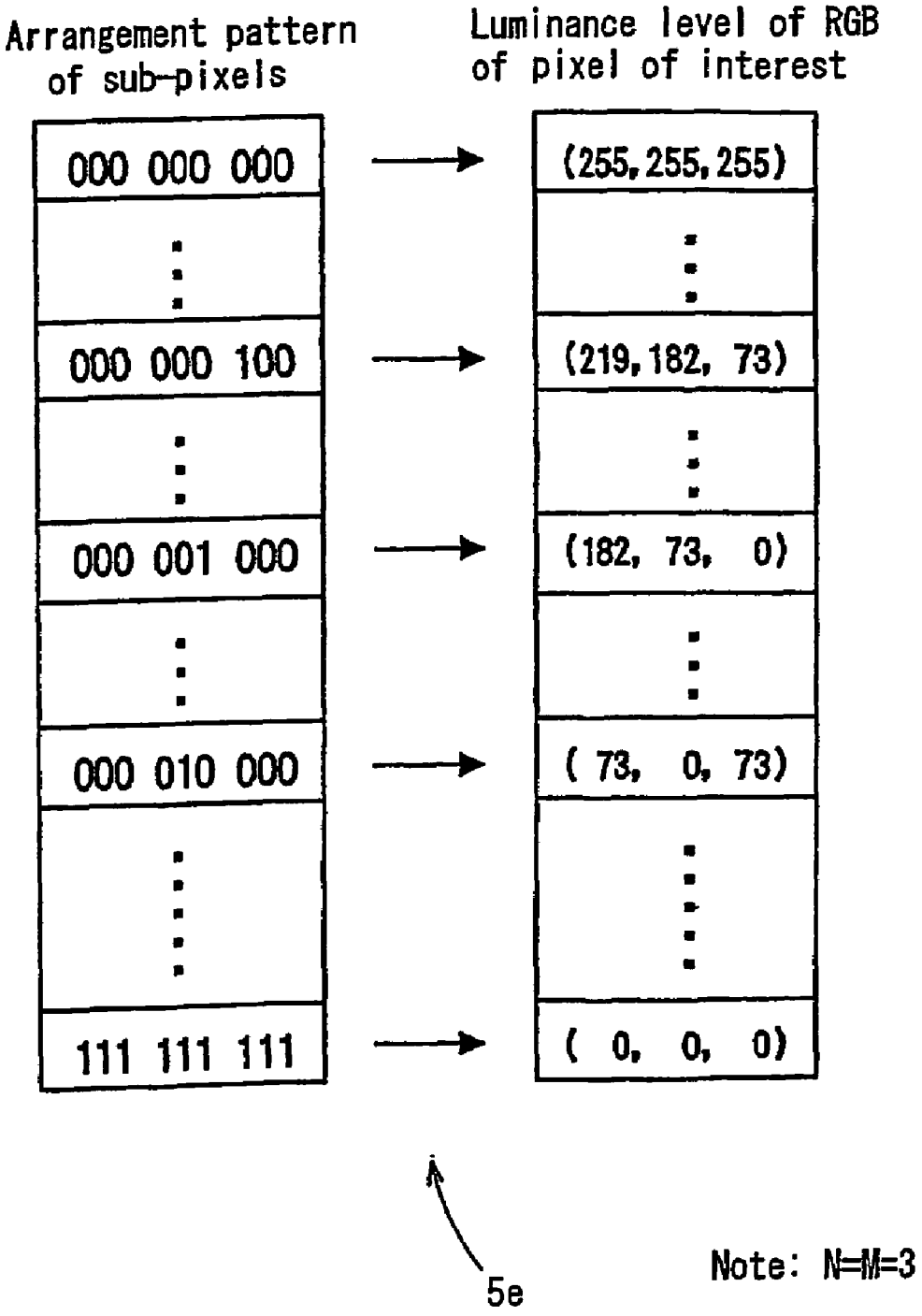
FIG. 4 is a diagram showing another example of a pixel value table in a character display apparatus according to an embodiment of the present invention.

FIG. 4 is a diagram showing another example of the pixel value table 5. The left-hand side of FIG. 4 shows an arrangement pattern of 9 sub-pixels contained in 3 pixels which are arranged in the same direction as that of the arrangement of the sub-pixels. The right-hand side of FIG. 4 shows the luminance value of each sub-pixel (R, G, B) contained in a pixel of interest corresponding to the arrangement pattern on the left side of FIG. 4.

The pixel value of a pixel is determined using the pixel value table 5*e* indicating a correspondence between the arrangement pattern of sub-pixels corresponding to the basic portion of a character and the luminance values of sub-pixels contained in a pixel whose pixel value is to be determined.

For example, it is assumed that the arrangement pattern of sub-pixels corresponding to a basic portion is "000 001 000". For example, when the correspondence indicated by the pixel value table 5*e* has been determined using the correction pattern 1 shown in FIG. 10, the arrangement of the color element levels is "001, 257, 521". The color element levels (2, 5, 7) of sub-pixels (R, G, B) contained in a pixel of interest whose pixel value is to be determined are converted to luminance levels (182, 73, 0) when the correspondence indicated by the pixel value table 5*e* has been determined using the correspondence between color element levels and luminance levels shown in FIG. 11. Therefore, in the pixel value table 5*e* of FIG. 4, the arrangement pattern "000 001 000" of the sub-pixels corresponding to a basic portion previously corresponds to the pixel values (182, 73, 0) of the pixel. The other arrangement patterns previously correspond to the pixel values of pixels.

As described above, the correspondence between the arrangement pattern of sub-pixels corresponding to a basic portion and the luminance values of the sub-pixels is predetermined in the pixel value table 5*e*. Therefore, when sub-pixels corresponding to a basic portion are near each other, the pixel values of pixels present between strokes can be controlled by adjusting the luminance values of sub-pixels corresponding to the arrangement pattern. Therefore, it is possible to prevent black pixels from filling between strokes of a character, i.e., space within the character is diminished, or the like. Thus, the quality of display can be improved.

Figure 5:
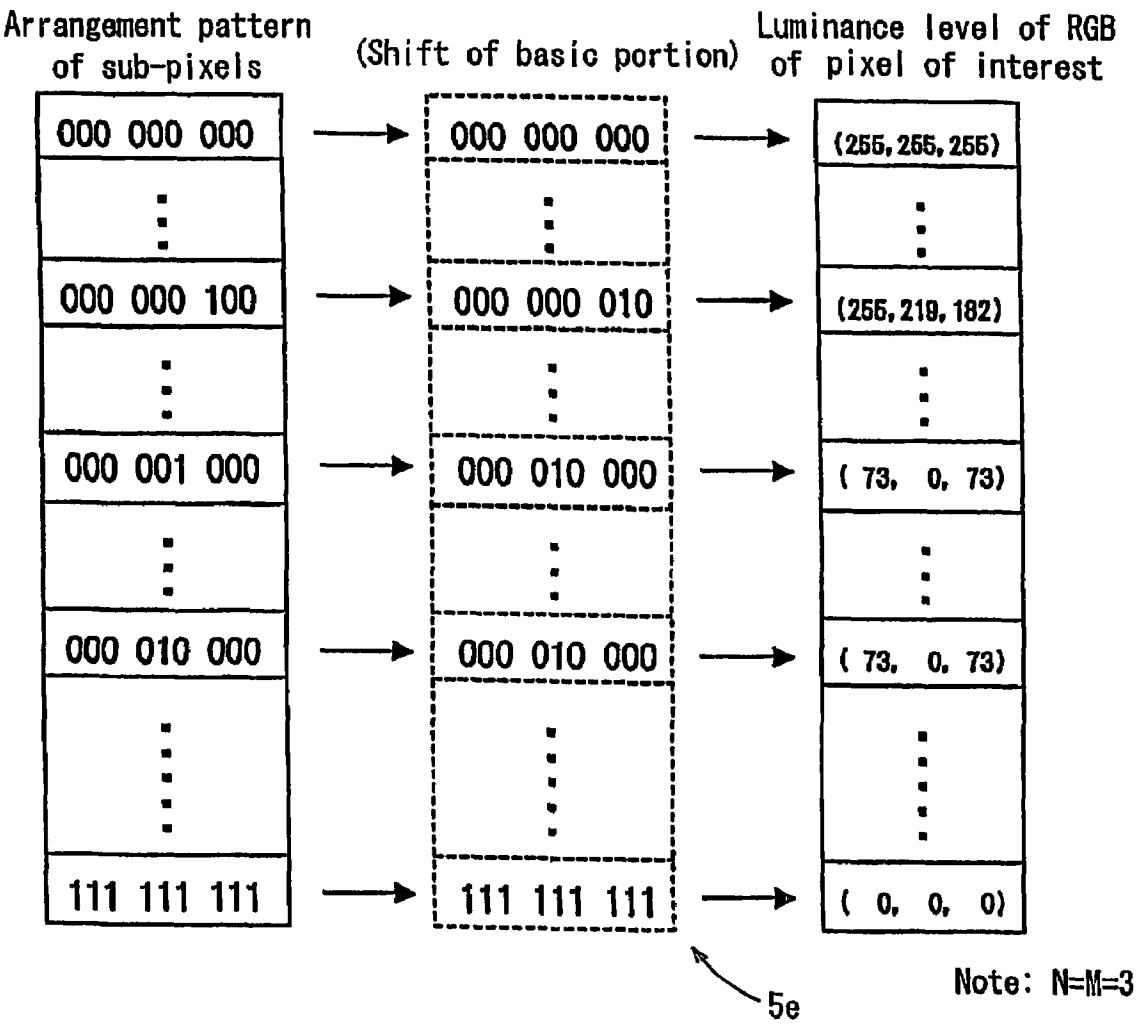
FIG. 5 is a diagram showing another example of a pixel value table in a character display apparatus according to an embodiment of the present invention.

FIG. 5 is a diagram showing another example of the pixel value table 5*e*. In this example, a basic portion is moved in order to prevent space within a character from being diminished. The left-hand side of FIG. 5 shows an arrangement pattern of 9 sub-pixels contained in 3 pixels which are arranged in the same direction as that of the arrangement of the sub-pixels. The middle of FIG. 5 shows an arrangement pattern of sub-pixels in which the value of an element relating to a sub-pixel to the left-handed side of the arrangement pattern to which a basic portion is assigned, is replaced with the value "0" of an element relating to a sub-pixel located at the middle of three sub-pixels contained in each pixel (a sub-pixel neighboring the sub-pixel to which a basic portion is assigned). The right-hand side of FIG. 5 shows the luminance value of each sub-pixel (R, G, B) contained in a pixel of interest, corresponding to each arrangement pattern in the middle of FIG. 5.

The pixel value of a pixel is determined using the pixel value table 5*e* indicating a correspondence between the arrangement pattern of sub-pixels corresponding to the basic portion of a character and the luminance values of sub-pixels contained in a pixel whose pixel value is to be determined.

For example, it is assumed that the arrangement pattern of sub-pixels corresponding to a basic portion is "000 001 000". By replacement of the basic portion, the arrangement of the sub-pixels is changed to "000 010 000". In this case, when the correspondence indicated by the pixel value table 5*e* has been determined using the correction pattern 1 shown in FIG. 10, the arrangement of the color element levels is "012, 575, 210". The color element levels (5, 7, 5) of sub-pixels (R, G, B) contained in a pixel of interest whose pixel value is to be determined are converted to luminance levels (73, 0, 73) when the correspondence indicated by the pixel value table 5*e* has been determined using the correspondence between color element levels and luminance levels shown in FIG. 11. Therefore, in the pixel value table 5*e* of FIG. 5, the arrangement pattern "000 001 000" of the sub-pixels corresponding to a basic portion previously corresponds to the pixel values (73, 0, 73) of the pixel. The other arrangement patterns previously correspond to the pixel values of pixels.

Figure 6:
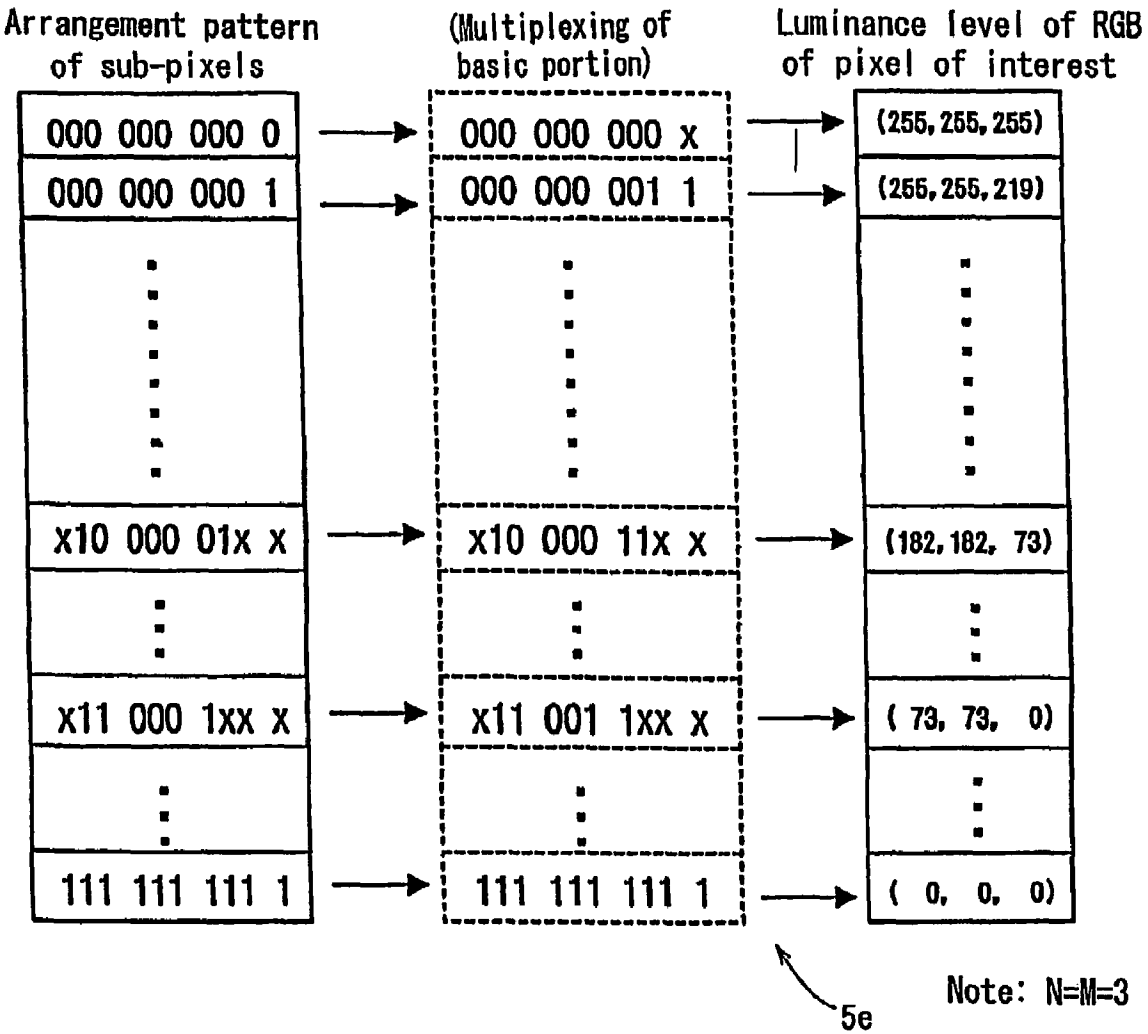
FIG. 6 is a diagram showing another example of a pixel value table in a character display apparatus according to an embodiment of the present invention.

FIG. 6 is a diagram showing another example of the pixel value table 5*e*. In FIG. 6, a duplicate of a basic portion is provided on the left side of the basic portion to thicken the line width of a character (multiplexing). The left-hand side of FIG. 6 shows an arrangement pattern of 9 sub-pixels contained in 3 pixels which are arranged in the same direction as that of the arrangement of the sub-pixels. The middle of FIG. 6 shows an arrangement pattern, in which in addition to a sub-pixel corresponding to a basic portion, a sub-pixel neighboring to the left-handed side of that pixel is changed to correspond to a basic portion where the value of a corresponding element of the arrangement pattern is changed "0" to "1". The right-hand side of FIG. 6 shows the luminance value of each sub-pixel (R, G, B) contained in a pixel of interest, corresponding to each arrangement pattern in the middle of FIG. 6.

The pixel value of a pixel is determined using the pixel value table 5*e* indicating a correspondence between the arrangement pattern of sub-pixels corresponding to the basic portion of a character and the luminance values of sub-pixels contained in a pixel whose pixel value to be determined.

For example, it is assumed that the arrangement of sub-pixels corresponding to a basic portion is "x10 000 01x x". By providing a duplicate of the basic portion to the left-hand side of the sub-pixel, the arrangement of the sub-pixels is changed to "x10 010 11x x". In this case, when the correspondence indicated by the pixel value table 5*e* has been determined using the correction pattern 1 shown in FIG. 10, the arrangement of the color element levels is "x75, 225, 77x, x". The color element levels (2, 2, 5) of sub-pixels (R, G, B) contained in a pixel of interest whose pixel value is to be determined are converted to luminance levels (182, 182, 73) when the correspondence indicated by the pixel value table 5*e* has been determined using the correspondence between color element levels and luminance levels shown in FIG. 11. Therefore, in the pixel value table 5*e* of FIG. 6, the arrangement pattern "x10 000 01x x" of the sub-pixels corresponding to a basic portion previously corresponds to the pixel values (182, 182, 73) of the pixel. The other arrangement patterns previously correspond to the pixel values of pixels.

Figure 7:
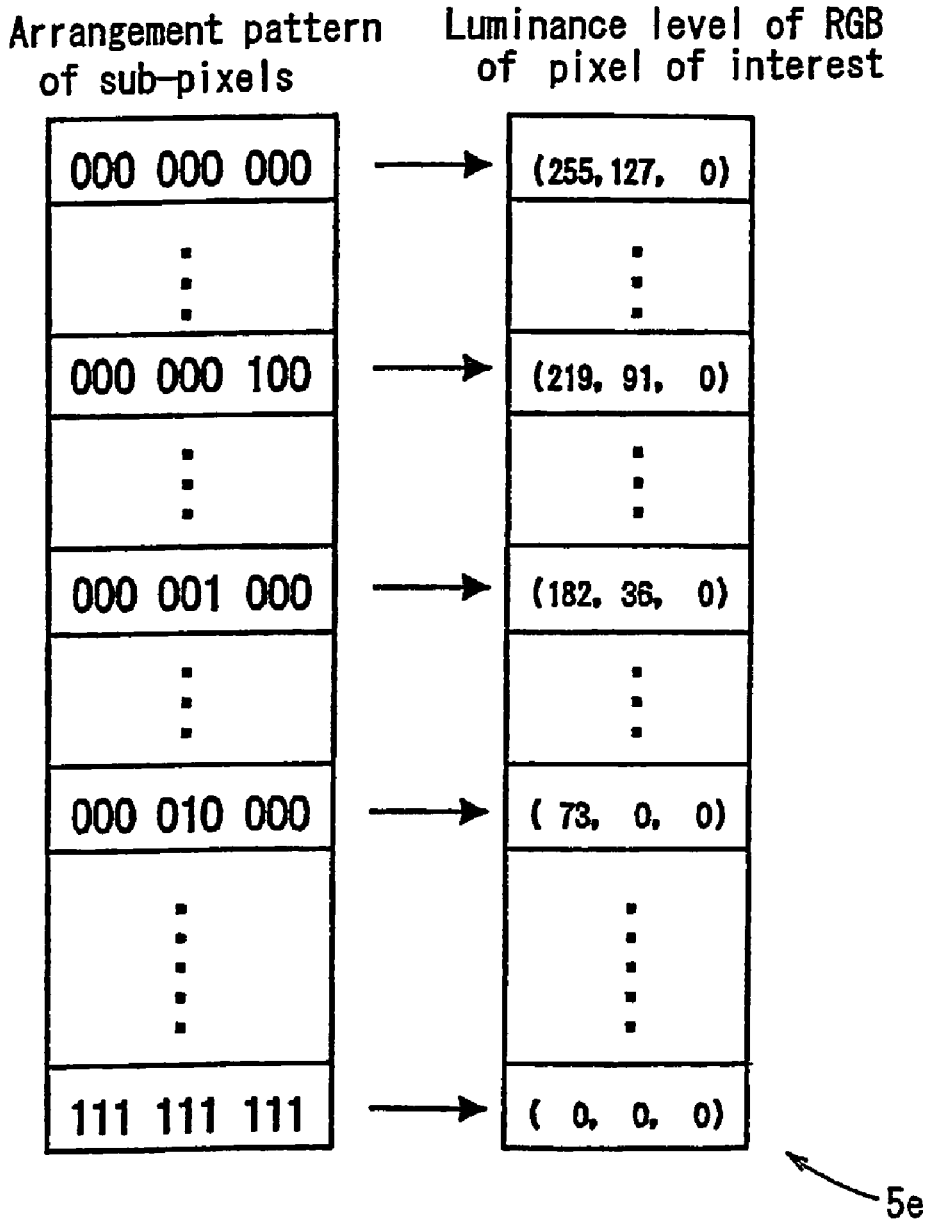
FIG. 7 is a diagram showing another example of a pixel value table in a character display apparatus according to an embodiment of the present invention.

FIG. 7 is a diagram showing another example of the pixel value table 5*e*. FIG. 7 shows a correspondence between the arrangement of sub-pixels corresponding to a basic portion and the pixel values (R, G, B) of pixels, where the color of a background is orange, i.e., (R, G, B)=(255, 127, 0). The left-hand side of FIG. 7 shows an arrangement pattern of 9 sub-pixels contained in 3 pixels which are arranged in the same direction as that of the arrangement of the sub-pixels. The right-hand side of FIG. 7 shows the luminance value of each sub-pixel (R, G, B) contained in a pixel of interest, corresponding to each arrangement pattern in the middle of FIG. 7.

The pixel value of a pixel is determined using the pixel value table 5*e* indicating a correspondence between the arrangement of sub-pixels corresponding to the basic portion of a character and the luminance values of sub-pixels contained in a pixel whose pixel value to be determined.

For example, it is assumed that the arrangement of sub-pixels corresponding to a basic portion is "000 000 000". In this case, there is no sub-pixel corresponding to the basic portion of a character. A pixel whose pixel value is to be determined corresponds to a background. Therefore, the luminance value of (R, G, B) is (255, 127, 0).

The color element levels of sub-pixels neighboring a basic portion, which are stepwise changed, are adjusted according to the distribution of luminance in the background color. For example, it is assumed that the arrangement of sub-pixels corresponding to the basic portion is "000 001 000". When the background color is white, the arrangement of color element levels is "001, 257, 521" as shown in FIG. 4. The color element levels (2, 5, 7) of sub-pixels (R, G, B) contained in a pixel of interest whose pixel value is to be determined are converted to luminance levels (182, 73, 0). In contrast, when the background color is orange, the ratio of the luminance levels (R, G, B) is (1, 1/2, 0). Therefore, the color element levels (2, 5, 7) of the sub-pixels (R, G, B) contained in the pixel of interest whose pixel value is to be determined are converted to luminance levels (182, 36, 0) where the level of G is adjusted to $73\times1/2\cong36$. Thus, in the pixel value table 5*e* of FIG. 7, the arrangement pattern "000 001 000" of the sub-pixels corresponding to the basic portion previously corresponds to the adjusted pixel values (182, 36, 0) of the pixel. The other arrangement patterns previously correspond to the pixel values of pixels.

A correspondence between the arrangement of sub-pixels and the pixel value of a pixel to be set for any character color and background color, can be adjusted according to the character color and background color based on the pixel value table 5*e* indicating a correspondence for a basic color combination, i.e., black characters in a white background as shown in FIGS. 3 and 4. For each color combination, the pixel value of a pixel can be determined according to a pixel value table 5*e* as shown in FIG. 7.

For each combination of a character cooler and a background color, a pixel value table as shown in FIG. 7 may be prepared, or the values of a pixel value table as shown in FIGS. 3 and 4 may be adjusted so as to determine a correspondence between the arrangement of sub-pixels and a pixel value. When there are a number of combinations of a character color and a background color, similar colors may be grouped and pixel value tables indicating a correspondence are prepared for respective representative colors. In this case, pixel value tables indicating a correspondence may be adjusted according to the size of a difference between the character and background colors and the representative color. For example, the sum of squares of differences between each color (R, G, B), the sum of absolute differences between each color (R, G, B), or the like, can be used as an indicator for determining the size of a color difference. A difference in color element level in color space (e.g., YUV space, Lab space, or the like) based on visual characteristics may be used as an indicator for determining a color difference. If a difference between a representative color assigned to the above-described pixel value table indicating a correspondence and a color specified in displaying a character is less than or equal to a predetermined threshold, the specified color is determined as a color belonging to a group including the representative color and the pixel value table can be used to determine the pixel value of a pixel.

Figures 9, 10:
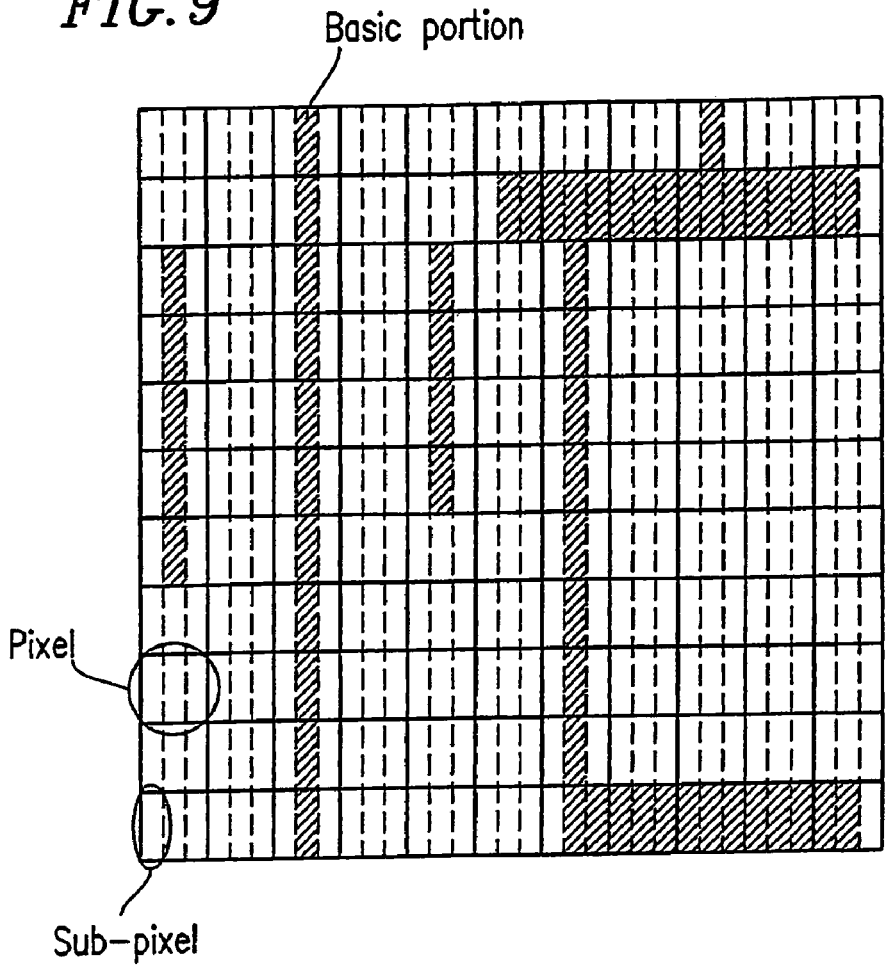
FIG. 9 is a diagram showing an exemplary pattern of sub-pixels corresponding to a basic portion for a Kanji character "忙".
FIG. 10 is a diagram showing an exemplary correction table in a character display apparatus.
Figure 12:
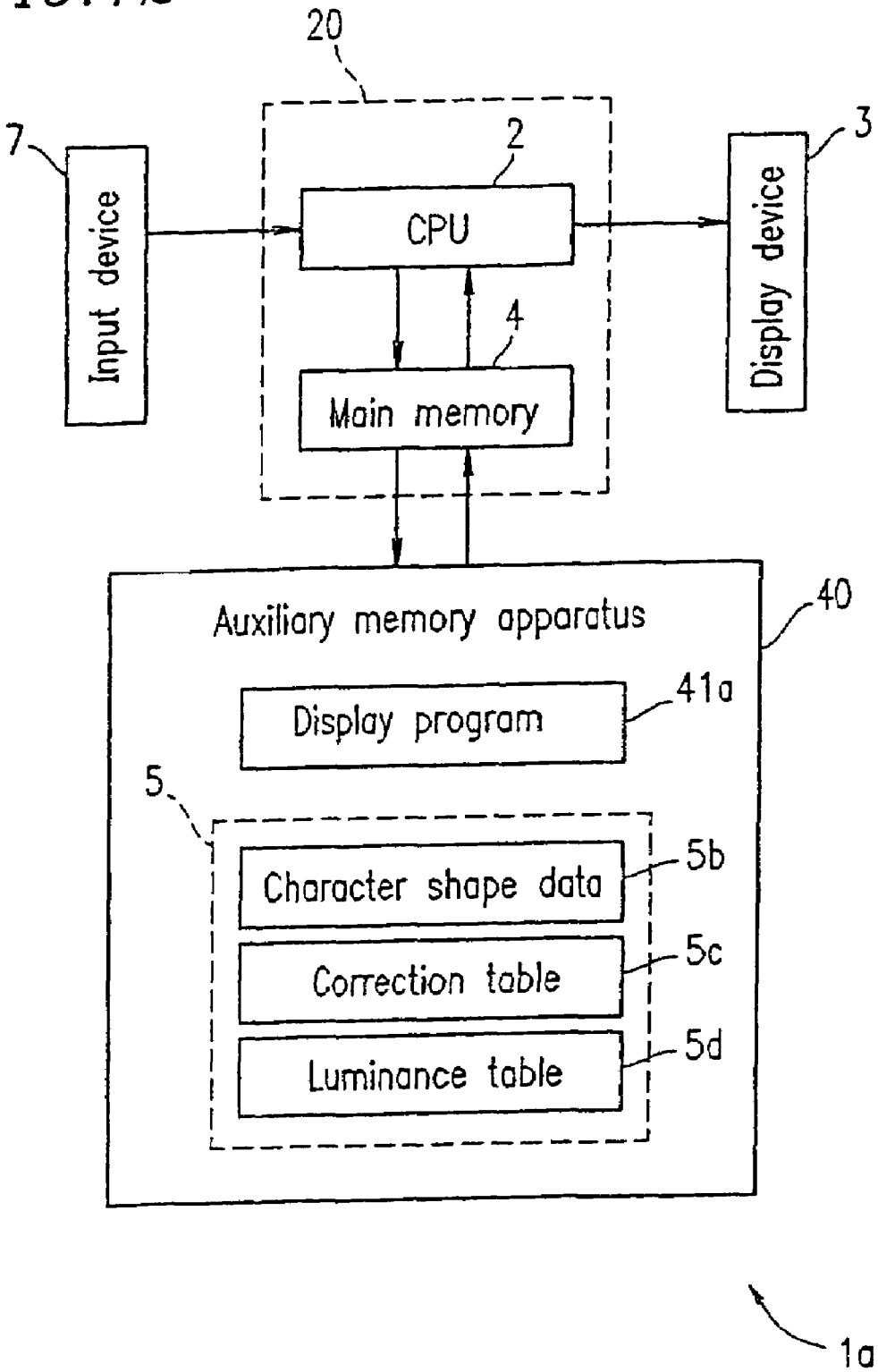
FIG. 12 CONVENTIONAL ART
FIG. 12 is a block diagram showing a structure of a conventional character display apparatus.
Figure 13A:
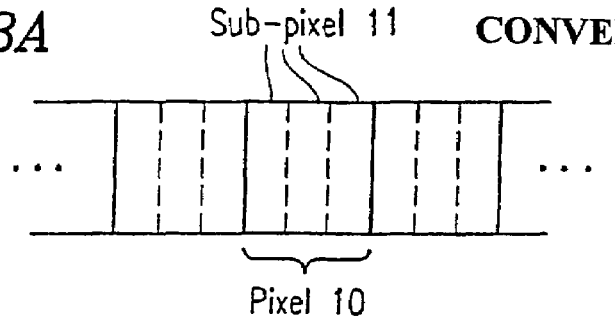
FIGS. 13A and 13B are diagrams for explaining a structure of sub-pixels and a correction pattern in a conventional character display apparatus.
Figure 13B:
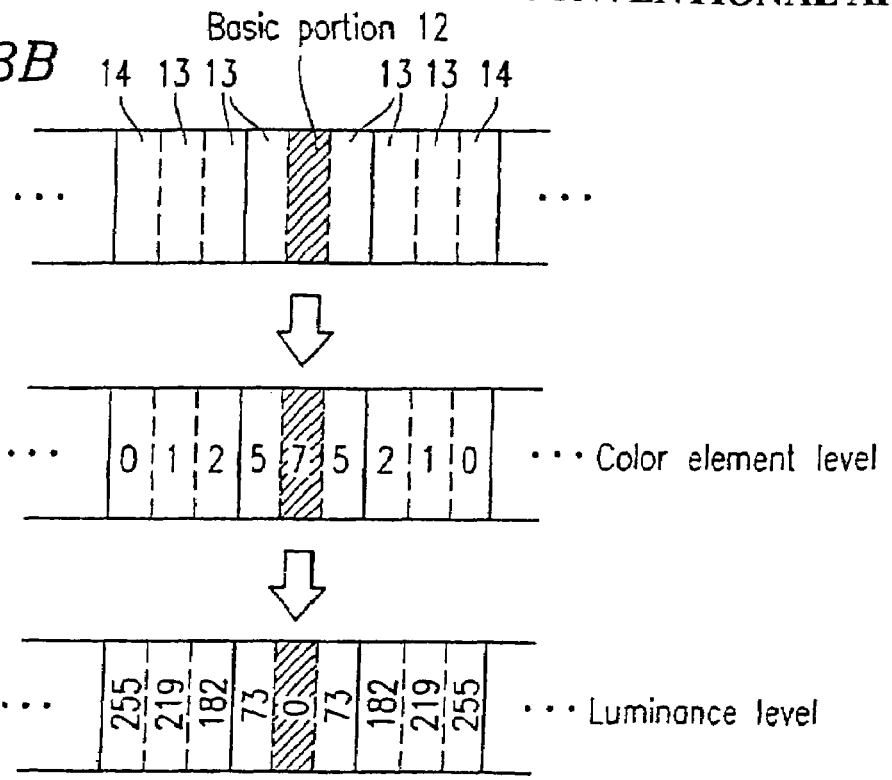
CONVENTIONAL ART FIG. 13B
Figure 14:
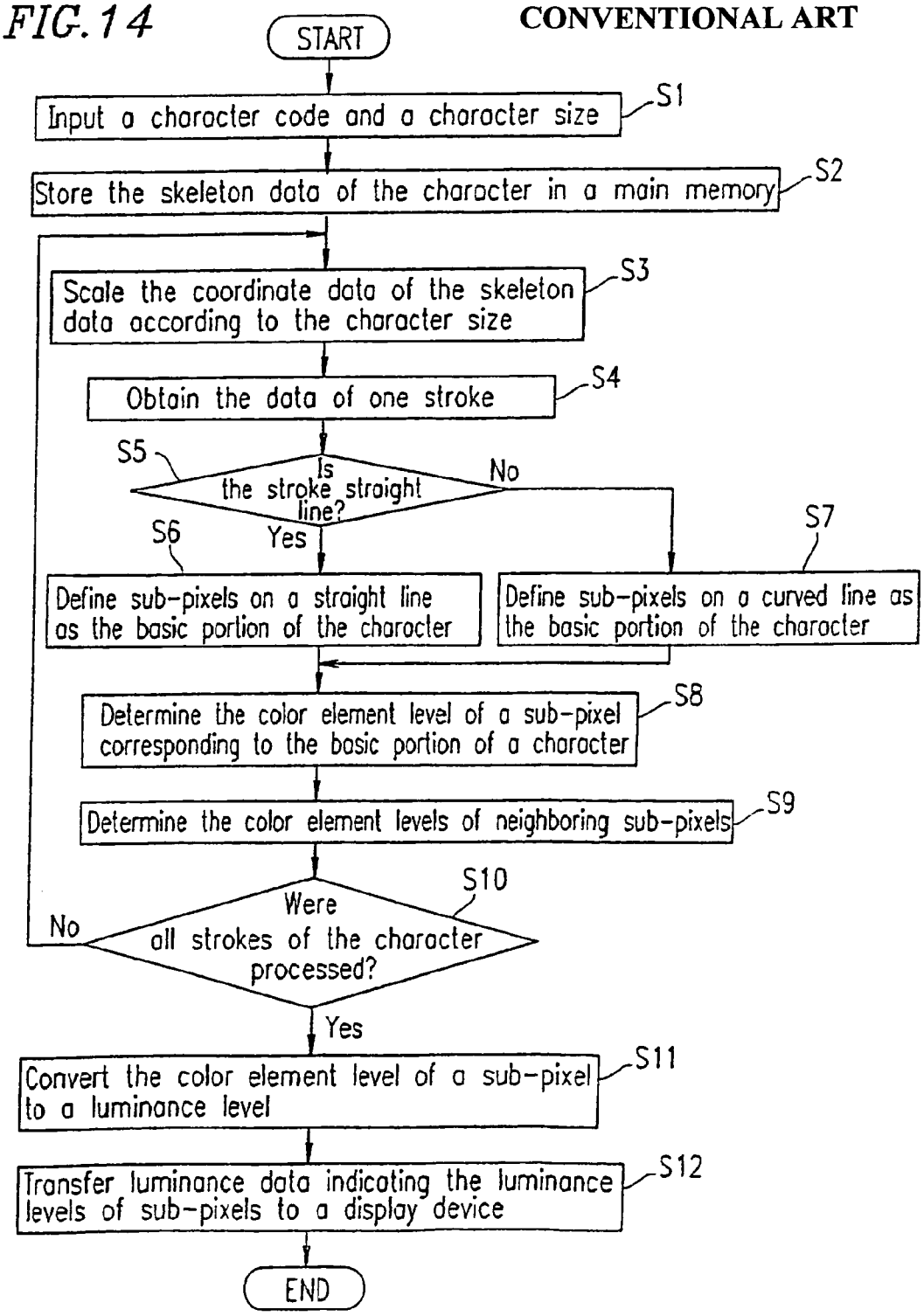
FIG. 14 CONVENTIONAL ART
FIG. 14 is a flowchart for explaining a conventional character display method.

The above-described pixel value table 5*e* indicating a correspondence between the arrangement of sub-pixels and the pixel value of a pixel has $2^{(M+2\times N)}$ entries of arrangement combinations of sub-pixels, i.e., the combinations of the presence or absence ("1" or "0") of a basic portion in (M+2×N) sub-pixels. For example, if M=N=3, the number of entries is 512. As shown in FIG. 10, however, correction patterns are predetermined, in which the color element levels of sub-pixels neighboring a sub-pixel corresponding to a basic portion are stepwise changed. Therefore, the sequence of the luminance values of sub-pixels is limited. When correction patterns overlap in a sub-pixel, the larger color element level is set in the sub-pixel. Therefore, the number of pixel values obtained by combinations of sub-pixels is 5×N+8 where M=3. Therefore, if M=N=3, the number of pixel values is 23. By assigning 23 indexes to 512 arrangement patterns, a data capacity for storing pixel values actually prepared can be reduced as compared to when 24-bit full color data is prepared in a table where each of (R, G, B) has a length of 8 bit (=0 to 255). Note that the number of combinations is not limited to 23 when pixel values are set more precisely.

As described above, a table indicating a correspondence between the arrangement pattern and luminance levels of sub-pixels in a direction along which R, G, and B are arranged, is used to determine the luminance levels of sub-pixels contained in a pixel of interest. The present invention is not so limited. Alternatively, the luminance level of sub-pixels in a pixel of interest may be determined based on an arrangement pattern of sub-pixels in a direction perpendicular (or oblique) to the direction along which R, G, and B are arranged, for example. In this case, a table indicating a correspondence between the arrangement pattern and luminance levels of sub-pixels arranged in the perpendicular (or oblique) direction, is used.

Figure 8:
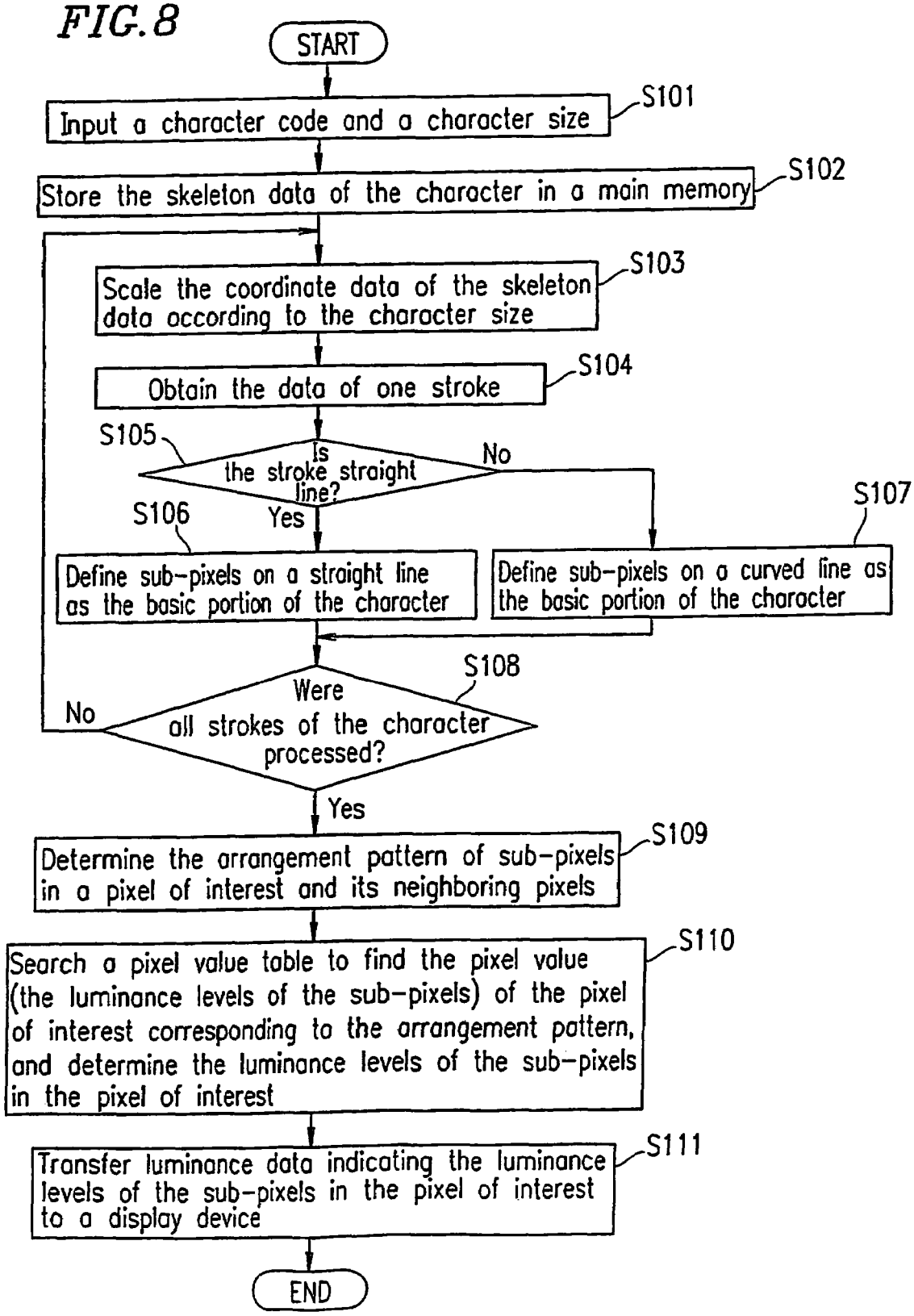
FIG. 8 is a flowchart for explaining a character display method according to an embodiment of the present invention.

FIG. 8 is a flowchart indicating a process flow of the display program 41*b* (FIG. 1) when the character shape data 5*b* is skeleton data.

In step S101, a character code and a character size are input through the input device 7. For example, when a Kanji character "木" is displayed on the display device 3, 4458 (JIS KUTEN code, 44th section and 58th point) is input as a character code. The character size is represented by the number of dots in a horizontal direction and the number of dots in a vertical direction, e.g., 20 dots×20 dots, for example.

In step S102, skeleton data corresponding to the input character code is read from the character shape data 5*b* in the auxiliary memory apparatus 40 and is then stored in the main memory 4 of the control apparatus 20. This skeleton data contains a character code for identifying the type of a character, the number of strokes constituting a single character, the number of points constituting a single stroke, the line type of a stroke, the coordinates of points constituting a single stroke, and the like.

In step S103, the coordinate data of points constituting each stroke is scaled according to the character size input through the input device 7. This scaling converts the coordinate data in the skeleton data defined in a predetermined coordinate system to a real pixel coordinate system for the display device 10. In this case, the scaling is performed by considering the arrangement of sub-pixels. As shown in FIG. 2A, for example, one pixel 10 comprises three sub-pixels 11 arranged in an X direction. When a character size is 20 dots×20 dots, the coordinate data of the skeleton data is scaled into data of 60(=20×3) pixels×20 pixels.

In step S104, the coordinate data of points constituting a stroke is obtained. In step S105, it is determined whether the type of the stroke is a straight line or a curved line from the line type of the stroke contained in the skeleton data. When the type of the stroke is a straight line, the process goes to step S106. When the type of the stroke is a curved line, but not a straight line, the process goes to step S107.

In step S106, the points constituting the stroke are linked with straight lines, and sub-pixels on the straight lines are defined as the basic portion representing the skeleton of a character. In step S107, the coordinate data of the points constituting the stroke is approximated by curved lines, and sub-pixels positioned on the curved lines are defined as the basic portion representing the skeleton of a character.

In step S108, it is determined whether or not all strokes contained in a character have been processed. If "Yes", the process goes to step S109. If "No", the process returns to step S103 and is continued.

In step S109, the arrangement pattern of the sub-pixels in a pixel of interest whose pixel value (the luminance levels of sub-pixels) is to be determined and its neighboring pixels, is determined.

In step S110, a pixel value of the pixel of interest corresponding to the arrangement pattern of the sub-pixels determined in step S109 is determined as the luminance levels of sub-pixels contained in the pixel of interest according to the pixel value table 5*e* indicating a correspondence between the arrangement pattern of sub-pixels corresponding to a basic portion and the pixel value (the luminance levels of sub-pixels) of a pixel.

In step S111, luminance data indicating the luminance levels of the sub-pixels set in step S110 is transferred to the display device 3.

As described above, the luminance level can be adjusted on a sub-pixel-by-sub-pixel basis based on the arrangement of sub-pixels corresponding to a basic portion for the purpose of displaying a character on the display device 3. In the above-described embodiment, sub-pixels corresponding to the basic portion indicating the skeleton of a character are obtained from skeleton data. Alternatively, such sub-pixels may be obtained from outline data, bitmap data, or the like by a predetermined process. Alternatively, the pattern of the basic portion may be previously stored as character shape data in the auxiliary memory apparatus 40 and may be read as required.

INDUSTRIAL APPLICABILITY

As described above, according to the present invention, when a character is displayed with a high resolution on a display section capable of displaying color, a luminance level to be displayed on the display section can be obtained directly by converting the arrangement pattern of sub-pixels corresponding to the basic portion representing the skeleton of a character. Therefore, the character display process can be performed at a higher rate and a working memory area for performing the character display process can be reduced. As a result, character display processing can be performed at a higher rate and the hardware cost can be reduced.

According to the present invention, when character strokes are close to each other, the positions of sub-pixels corresponding to the basic portion representing the skeleton of a character can be adjusted to easily prevent deformation of a character. Further, in addition to a sub-pixel corresponding to the basic portion representing the skeleton of a character, its neighboring sub-pixels are allowed to represent the basic portion, thereby making it possible to easily increase the line width of the character.

Any color may be assigned to a character to be displayed and a background. In this case, by changing a correspondence between the arrangement of sub-pixels and the luminance levels of sub-pixels according to the character color and the background color, it is possible to provide a character display in which the shape of a character is retained and a high level of visibility is achieved irrespective of a color combination.

Similar combinations of a character color and a background color may be grouped. In this case, correspondences between the arrangement pattern of sub-pixels corresponding to a basic portion and the pixel value of a pixel for a group of color combinations can be merged into a correspondence for a representative color combination. Therefore, a data amount required for a correspondence table between the arrangement pattern of sub-pixels corresponding to a basic portion and the pixel value of a pixel can be reduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

The invention claimed is:

1. A character display apparatus, comprising:

a display device comprising a plurality of pixels; and a control section for controlling the display device, wherein each of the plurality of pixels comprises a plurality of sub-pixels arranged in a predetermined direction, and at least one of a plurality of color elements is assigned to each of the plurality of sub-pixel;

the control section determines at least one sub-pixel, to which a basic portion indicating a skeleton of a character is assigned, among the plurality of sub-pixels in the display device, based on character shape data indicating character shapes;

a first pixel of the plurality of pixels comprises a plurality of first sub-pixels;

at least one pixel neighboring the first pixel comprises a plurality of second sub-pixels;

the control section determines an arrangement pattern containing a plurality of elements, wherein a value of each of the plurality of elements is determined depending on whether or not the basic portion is assigned to a corresponding sub-pixel of the plurality of the first sub-pixels and the plurality of the second sub-pixels; and the control section introduces a predetermined change into the arrangement pattern, the predetermined change including one of replacement of a position of the basic portions and duplication of the basic portion, and determines a luminance level of only the first pixel based on the changed arrangement pattern, wherein the luminance level of the first pixel based on the changed arrangement pattern is determined using a stored table indicating a predetermined correspondence between arrangement patterns of sub-pixels and luminance levels of sub-pixels arranged in a certain direction, which is one of the same as the predetermined direction and different from the predetermined direction, and the correspondence indicated by the stored table is determined using a predetermined correction pattern of color element levels of sub-pixels neighboring a sub-pixel corresponding to the basic portion.

2. An apparatus according to claim 1, wherein the plurality of elements include a first element and a second element neighboring the first element;

a value of the first element indicates that the basic portion is assigned to a sub-pixel relating to the first element;

a value of the second element indicates that the basic portion is not assigned to a sub-pixel relating to the second element; and the control section determines the luminance level of the first pixel based on another arrangement pattern which is modified from said arrangement pattern such that a value of the first element is interchanged with a value of the second element.

3. An apparatus according to claim 1, wherein the plurality of elements include a first element and a second element neighboring the first element;

a value of the first element indicates that the basic portion is assigned to a sub-pixel relating to the first element;

a value of the second element indicates that the basic portion is not assigned to a sub-pixel relating to the second element; and the control section determines the luminance level of the first pixel based on another arrangement pattern which is modified from said arrangement pattern such that a value of the second element is changed to indicate that the basic portion is assigned to the sub-pixel relating to the second element.

4. An apparatus according to claim 1, wherein the control section determines the luminance level of the first pixel based on a combination of a color of the character and a background color of the character and the arrangement pattern.

5. An apparatus according to claim 1, wherein the control section compares a combination of a color of the character and a background color of the character with a combination of a predetermined character color and a predetermined background color, and determines the luminance level of the first pixel based on a result of the comparison and the arrangement pattern.

6. A method for displaying a character on a character display apparatus, wherein the character display apparatus comprises:

a display device comprising a plurality of pixels; and a control section for controlling the display device, wherein each of the plurality of pixels comprises a plurality of sub-pixels arranged in a predetermined direction, and at least one of a plurality of color elements is assigned to each of the plurality of sub-pixel;

a first pixel of the plurality of pixels comprises a plurality of first sub-pixels; and at least one pixel neighboring the first pixel comprises a plurality of second sub-pixels, the method comprises the steps of:

determining at least one sub-pixel, to which a basic portion indicating a skeleton of a character is assigned, among the plurality of sub-pixels in the display device, based on character shape data indicating character shapes;

determining an arrangement pattern containing a plurality of elements, wherein a value of each of the plurality of elements is determined depending on whether or not the basic portion is assigned to a corresponding sub-pixel of the plurality of the first sub-pixels and the plurality of the second sub-pixels; and introducing a predetermined change into the arrangement pattern, the predetermined change including one of replacement of a position of the basic portions and duplication of the basic portion, and determining a luminance level of only the first pixel based on the changed arrangement pattern, wherein the luminance level of the first pixel based on the changed arrangement pattern is determined using a stored table indicating a predetermined correspondence between arrangement patterns of sub-pixels and luminance levels of sub-pixels arranged in a certain direction, which is one of the same as the predetermined direction and different from the predetermined direction, and the correspondence indicated by the stored table is determined using a predetermined correction pattern of color element levels of sub-pixels neighboring a sub-pixel corresponding to the basic portion.

7. A recording medium storing a program for causing a character display apparatus to execute a character display process, wherein the recording medium is readable by the character display apparatus, the character display apparatus comprises:

a display device comprising a plurality of pixels; and a control section for controlling the display device, wherein each of The plurality of pixels comprises a plurality of sub-pixels arranged in a predetermined direction, and at least one of a plurality of color elements is assigned to each of the plurality of sub-pixel;

a first pixel of the plurality of pixels comprises a plurality of first sub-pixels; and at least one pixel neighboring the first pixel comprises a plurality of second sub-pixels, and The character display process comprises the steps of:

determining at least one sub-pixel, to which a basic portion indicating a skeleton of a character is assigned, among the plurality of sub-pixels in the display device, based on character shape data indicating character shapes;

determining an arrangement pattern containing a plurality of elements, wherein a value of each of the plurality of elements is determined depending on whether or not the basic portion is assigned to a corresponding sub-pixel of the plurality of the first sub-pixels and the plurality of the second sub-pixels; and introducing a predetermined change into the arrangement pattern, the predetermined change including one of replacement of a position of the basic portion and duplication of the basic portion, and determining a luminance level of only the first pixel based on the changed arrangement pattern, wherein the luminance level of the first pixel based on the changed arrangement pattern is determined using a stored table indicating a predetermined correspondence between arrangement patterns of sub-pixels and luminance levels of sub-pixels arranged in a certain direction, which is one of the same as the predetermined direction and different from the predetermined direction, and the correspondence indicated by the stored table is determined using a predetermined correction pattern of color element levels of sub-pixels neighboring a sub-pixel corresponding to the basic portion.

* * * * *